US006796822B2

(12) United States Patent
Sato et al.

(10) Patent No.: US 6,796,822 B2
(45) Date of Patent: Sep. 28, 2004

(54) CONTACT MODULE AND CONNECTOR HAVING THE SAME

(75) Inventors: Shiho Sato, Shinagawa (JP); Takeshi Ito, Shinagawa (JP); Noboru Shimizu, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/401,771

(22) Filed: Mar. 31, 2003

(65) Prior Publication Data

US 2004/0005816 A1 Jan. 8, 2004

(30) Foreign Application Priority Data

Jul. 2, 2002 (JP) ..... 2002-193882
Jul. 2, 2002 (JP) ..... 2002-193883

(51) Int. Cl.[7] ..... H01R 13/62
(52) U.S. Cl. ..... 439/260; 439/632
(58) Field of Search ..... 439/260, 259, 439/261, 262–265, 59, 62, 632, 593, 325, 327, 636, 631, 67, 637

(56) References Cited

U.S. PATENT DOCUMENTS 4,560,221 A 12/1985 Olsson
4,660,920 A * 4/1987 Shibano ..... 439/631
5,163,835 A * 11/1992 Morlion et al. ..... 439/67
5,575,661 A 11/1996 Grabbe et al.
6,238,226 B1 * 5/2001 Schempp et al. ..... 439/260
6,379,188 B1 * 4/2002 Cohen et al. ..... 439/608

* cited by examiner

*Primary Examiner*—Alex Gilman
(74) *Attorney, Agent, or Firm*—Staas & Halsey LLP

(57) ABSTRACT

A contact module includes: a strip base; and a plurality of first and second protrusions continuously extending from the first and second ends of the base, respectively. The second end is opposite to the first end. The first and second protrusions include the same materials as the base. Each of the first and second protrusions includes first and second contact portions, respectively. The base includes a sheet made of a metal material, an insulating film formed on at least one side of the sheet, and a film including a noble metal material formed on the insulating film. The film forms the first and second contact portions and circuit patterns. The circuit patterns are formed between the first and second contact portions. The first and second contact portions and the circuit patterns integrally form a plurality of contacts. Each of the contacts includes one of the first contact portions, a corresponding one of the second contact portions, and the circuit pattern therebetween.

19 Claims, 36 Drawing Sheets

CONTACT MODULE AND CONNECTOR HAVING THE SAME

BACKGROUND OF THE INVENTION

1. Field of the Invention

The present invention relates to connectors used for electrically connecting such as electronic devices and contact modules provided in the connectors.

2. Description of the Related Art

Connectors are used for electrically connecting a plurality of electronic devices or electronic components.

The connectors are classified into various types according to the shapes and the like.

For example, according to the mounting patterns, the connectors can be classified as connectors for boards connected to boards, LSI sockets connected to LSIs, and relay connectors used for connecting cables to cables.

Among the above described various connectors, the connectors for boards, for example, can be further divided into two major categories: the card edge type and the two piece type.

Card edge type connectors shown in FIGS. 1 and 2 are used for connection between a mother board 1 and a daughter card 2. The card edge type connectors are constructed such that a pair of contacts (terminals) 4 hold tight pads 3 provided on patterns (not shown) formed on both sides of the daughter card 2. In other words, the patterns of the daughter card 2 are used as the insertion side. A connector 5*a* in FIG. 1 is a throughhole mounting type connector that is mounted on the mother board 1 by inserting, soldering and fixing one end of each of the contacts 4 in a throughhole (not shown) formed on the mother board 1. A connector 5*b* in FIG. 2 is a surface mounting type connector that is mounted on the mother board 1 by soldering and fixing one end of each of the contacts 4 to a pad 6 formed on the mother board 1.

A two piece type connector 5*c* shown in FIG. 3 is used such that two connectors 5*c*-1 and 5*c*-2, a receiving connector and an inserting connector, are mounted on two boards 1 and 7, respectively, and the two connectors 5*c*-1 and 5*c*-2 are made to fit.

As mentioned above, there are differences in the connector shapes depending on the mounting patterns. However, each of the above-described connectors for boards, LSI sockets and relay connectors is constructed such that a lot of contacts formed into pin shapes or tongue shapes using a metal material are accommodated in a housing (designated by reference numeral 8 in FIGS. 1 through 3) formed by insulating resin.

If the contacts are of press fit types and have pin-like shapes, for example, the contacts are formed by notching, stamp-out pressing, bending, or form pressing a flat metal material. In addition, if the contacts are formed into a tongue shape, similarly, a flat metal material is notched or stamp-out pressed so as to obtain a lot of contacts. Normally, spring characteristics are given to the contacts by using a plate made of a metal material. Also, the contacts are plated with gold after performing base plating thereon so as to obtain good electric conductivity.

By the way, it is required that the connectors possess predetermined characteristics as connecting components as well as electrical characteristics that will be described later.

That is, when mounting the connector to a board or the like, it is preferable that force required for connecting contacts of the connector to such as electrodes of the board, in other words, force required for inserting the connector to a connecting hole or the like of the board, be small. Further, it is necessary that the contacts positively establish contact with such as electrodes of the board after the insertion. Thus, the so-called LIF (Low Insertion Force) structure is used in which spring characteristics are given to the contacts so that great contact force is exerted after the insertion of the contact with a small contact force.

On the other hand, at the insertion of the contact, it is not preferable that the contacts be worn or damaged such that the contact slidably contact such as the electrode. For this reason, the so-called ZIF (Zero Insertion Force) structure is also used in which the contacts and such as electrodes are maintained in a non-contact state and the contacts do not slidably contact such as electrode until the completion of the connection (insertion). Additionally, from these points of view, various shapes and materials of the contacts, various methods for surface treatment and the like are developed.

Regarding the connector, in addition to the above-described specific characteristics, similar to electric components such as a distributing board, a smaller connector, higher-density (narrower pitch) mounting of the contacts, speeding up of transmission rate, that is, improvement of the transmission rate and noise reduction by controlling such as crosstalk are always required.

A conventional connector, however, is formed into a pin shape and the like as described above. Thus, it is reasonable to say that there is a limit to the smaller connector or the higher-density mounting of the contacts. For example, as for the higher-density mounting of the contacts, it is difficult to make the pitch between the contacts equal to or less than 0.2–0.3 mm.

Additionally, since the conventional connector is formed with a three dimensional structure as mentioned above, the conventional connector is designed and manufactured by simulation through a three dimensional CAD or CAE such that the electric characteristics meet a predetermined specification. However, since the shape is complex, it is difficult to control the variation of the characteristic impedance to fall within a range of ±10%. Hence, it is difficult to eliminate noise due to impedance mismatching.

SUMMARY OF THE INVENTION

It is a general object of the present invention to provide an improved and useful contact module and connector having the contact module in which the above-mentioned problems are eliminated.

It is another and more specific object of the present invention to provide a contact module and connector having the contact module that can realize a smaller apparatus (connector) and higher-density mounting of the contacts to be mounted and perform impedance matching with good accuracy.

In order to achieve the above-mentioned objects, according to one aspect of the present invention, there is provided a contact module that includes: a strip base; a plurality of first protrusions continuously extending from a first end of the base and including the same materials as the base, said first protrusions each having a first contact portion and having spring characteristics at least in a part including said first contact portion; and a plurality of second protrusions continuously extending from a second end of the base and including the same material as the base, said second protrusions each having a second contact portion and having spring characteristics at least in a part including said second contact portion, the second end being opposite to the first end; wherein said base comprises a sheet made of a metal material, an insulating film formed on at least one side of said sheet, and a film including a noble metal material formed on the insulating film, wherein said film forming said first and second contact portions and circuit patterns, said circuit patterns being formed between the first and second contact portions; wherein the first and second contact portions and the circuit patterns integrally form a plurality of contacts, said contacts each comprising one of the first contact portions, a corresponding one of the second contact portions, and the circuit pattern therebetween.

Also, according to another aspect of the present invention, there is provided a connector including: a connector body; and at least one pair of the above-described contact modules provided in the connector body in a mutually opposing manner, the connector body including a pair of press members pressing the contact portions backward and forward so as to change the distance between the opposing first contact portions of the pair of the contact modules.

Here, the circuit patterns includes one of wiring patterns and wires according to specific embodiments. In addition, a material other than a noble metal material, that is, a base metal material, is not excluded for the construction material of the contact portions (contact points) and circuit patterns. However, a noble metal material is preferable for the construction material of the contact portions and circuit patterns in view of obtaining contacts with good mechanical characteristics, such as good abrasion resistance, hostile-environment resistance, and corrosion resistance. In this case, the noble metal material may be one kind of noble metal or several kinds of noble metals. Also, the insulating film, contact portions and circuit patterns may be formed on only one side of the sheet or both sides of the sheet.

Accordingly, it is possible to form thin contacts and to arrange a large number of the contacts finely with a narrow pitch. Hence, it is possible to realize a smaller connector and higher-density mounting of the contacts.

In addition, since the contacts are formed by the thin film-like contact portions and circuit patterns, it is possible to perform impedance matching with good accuracy.

Further, the circuit patterns may be covered with the insulating film with only the contact portions exposed. Thus, compared with a case where the circuit patterns are not covered with the insulating film, when using the connector in which the contact modules are provided, it is possible to prevent such as disconnection due to abrasion and damage even if the circuit patterns of the contacts contact another member, such as a board.

Moreover, by making the sheet including a metal material function as a ground layer, a micro strip line structure can be achieved. Thus, crosstalk and noise are reduced.

Furthermore, in a case of a conventional connector having a structure where a plurality of contacts are arranged, in a state where the connector is mounted to such as a board, it is difficult to avoid occurrence of differences in transmission distances (wiring lengths) of wiring patterns among the contacts when the contacts are connected to the wiring patterns on the board. This leads to a problem especially in a case of balanced transmission, for example. On the other hand, according to the present invention, it is possible to improve this problem by performing an adjustment in advance that provides differences in the pattern lengths of the circuit patterns.

In addition, it is possible to easily give spring characteristics to the sheet made of a metal material. Thus, it is possible to insert the contacts into a mating member by bending the contacts and to obtain contact force through restoring force of the contacts after the insertion.

Additionally, if the adjacent contacts (circuit patterns) are configured to function as a pair of signal lines for balanced transmission, it is possible to preferably reduce crosstalk as in the so-called edge couple in a circuit board. Also, signal coupling can be made as firm as in a circuit board.

Further, the contacts may include a ground contact that functions as a ground line. Also, the ground contact may include in the insulating film at least one slit that extends in the width direction of the ground contact and is arranged in the longitudinal direction of the ground contact so as to expose the sheet from the slit and make the circuit pattern contact the sheet via the slit.

Also, the ground contact may include a long groove extending in the longitudinal direction of the ground contact so as to expose the sheet from the slit and make the circuit pattern contact the sheet via the long groove.

Accordingly, it is possible to make a more positive ground.

In addition, each of the first and second contact portions may be biforked.

Accordingly, when connecting the connector in which the contact modules are provided to another electric component or the like, it is possible to more positively obtain continuity (connection).

Furthermore, it is possible to easily adjust contact force of the contacts by the press members.

In this case, the pair of the press members may each include: a slider-member provided on a back surface side of a corresponding one of the contact modules, catching ends of the first protrusions of the corresponding contact module, and being capable of sliding so as to vary the distance between the opposing first contact portions; and a fitting member mounted between the slider member and the connector body after the first board is inserted between the pair of the contact modules so as to slide the slider member.

In such a case, it is possible to realize the ZIF (Zero Insertion Force) structure by inserting the board in a state where the pair of the slider members are slid and opened so that the distance between the facing contact portions (contacts) becomes greater than the thickness of the board and, after the board is held, mounting the fitting members and sliding the slider members so as to press the contact portions and make the contact portions contact the board.

In addition, the pair of the press members may each include: a slider member provided on a back surface side of a corresponding one of the contact modules, catching ends of the first protrusions of the corresponding contact module, and being capable of sliding so as to vary the distance between the opposing first contact portions; an elastic member installed between a back surface of the slider member and an inner wall of the connector body and urging the slider member to slide; and a fitting member mounted between the slider member and the connector body after the first board is inserted between the pair of the contact modules so as to slide the slider member.

In such a case, the LIF (Low Insertion Force) structure is realized by adjusting the urging force of the elastic members to satisfy a predetermined condition, inserting the board while bringing the board into light contact with the contact portions in a state where the distance between the facing contact portions (contacts) is made approximately the same as or slightly smaller than the thickness of the board, and after the board is held, mounting the fitting members and further sliding the sliding members so as to further press the contact portions. Also, when inserting the board between the pair of the contacts, the contact portions are in slight sliding contact with the board. Hence, it is possible to clean the contact portions and the surfaces of the board.

Further, in each of the contact modules, the first protrusions are projected toward the insertion position of the first board, a circuit pattern side of the contact module from the first contact portions is fixed to the connector body, and top sides of the first protrusions, opposite to the circuit pattern side, are caught by a concave part formed in the slider member.

In such a case, the top sides of the contacts can be displaced in the concave parts. Thus, compared with a case where the top sides of the contacts are fixed to the connector body, it is possible to let excessive force applied to the contacts dissipate by the displacement of the top sides of the contacts. Accordingly, it is possible to easily obtain just enough contact force at the insertion of the board.

Additionally, in each of the contact modules, the second protrusions are bent and formed into substantially L-shapes, the corners of the L-shaped second protrusions are connected, as the second contact portions, to terminals formed on the second board to which principal surface the first board is arranged perpendicularly, a circuit pattern side of the contact modules from the second contact portions are fixed to the connector body, and top sides of the second protrusions, opposite to the circuit pattern side, are caught by a concave part formed in the connector body.

In such a case, the top sides of the contacts can be displaced in the concave parts. Thus, compared with a case where the top sides of the contacts are fixed to the connector body, it is possible to let excessive force applied to the contacts dissipate by the displacement of the top sides of the contacts. Accordingly, it is possible to easily obtain just enough contact force at the insertion of the board.

Additionally, in the second protrusions of the contact module, parts including the respective second contact portions may be formed into pin shapes so as to be put through throughholes formed in the second board so that the first board is fixed to the second board to which principal surface the first board is arranged perpendicular.

In such a case, it is possible to positively connect the contacts (connector) to another (second) board.

Moreover, the pair of the contact modules may hold the first and second boards between the first and second contact portions, respectively, so as to connect the first and second boards in a horizontal direction.

Such a structure is ideal since it is not necessary to use two connectors (two piece type connector).

Furthermore, in this case, a plurality of pairs of the contact modules may be provided in the connector body in a mutually opposing manner such that at least one of the first and second contact portions are arranged along an insertion direction of at least one of the first and second boards.

Such a structure is ideal for performing connection with a board where high-density wiring patterns are formed and terminals (pads) connected to the wiring patterns are arranged alternately in a hound's tooth pattern.

Other objects, features and advantages of the present invention will become more apparent from the following detailed description when read in conjunction with the following drawings.

DETAILED DESCRIPTION OF THE PREFERRED EMBODIMENTS

A description will be given of preferred embodiments of the present invention, with reference to the drawings.

Figure 1:
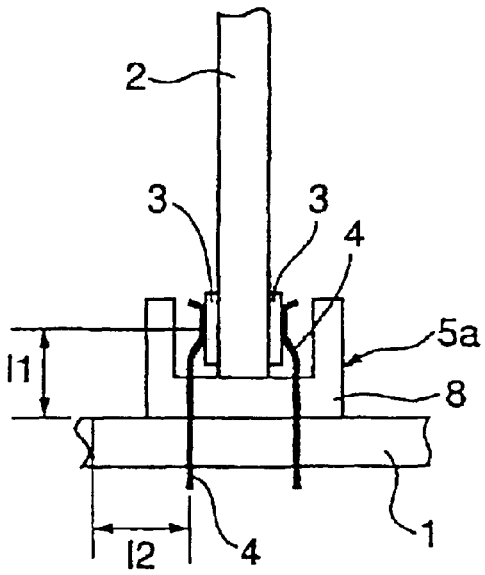
FIG.1 PRIOR ART
FIG. 1 is a schematic diagram showing the general structure of a conventional card edge type connector.
Figure 2:
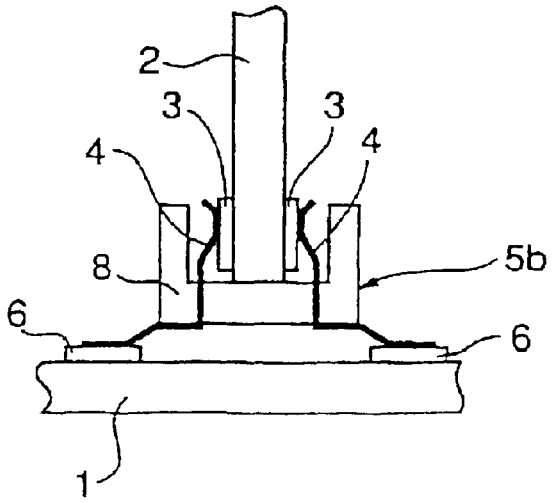
FIG.2 PRIOR ART
FIG. 2 is a schematic diagram showing the general structure of another conventional card edge type connector.
Figure 3:
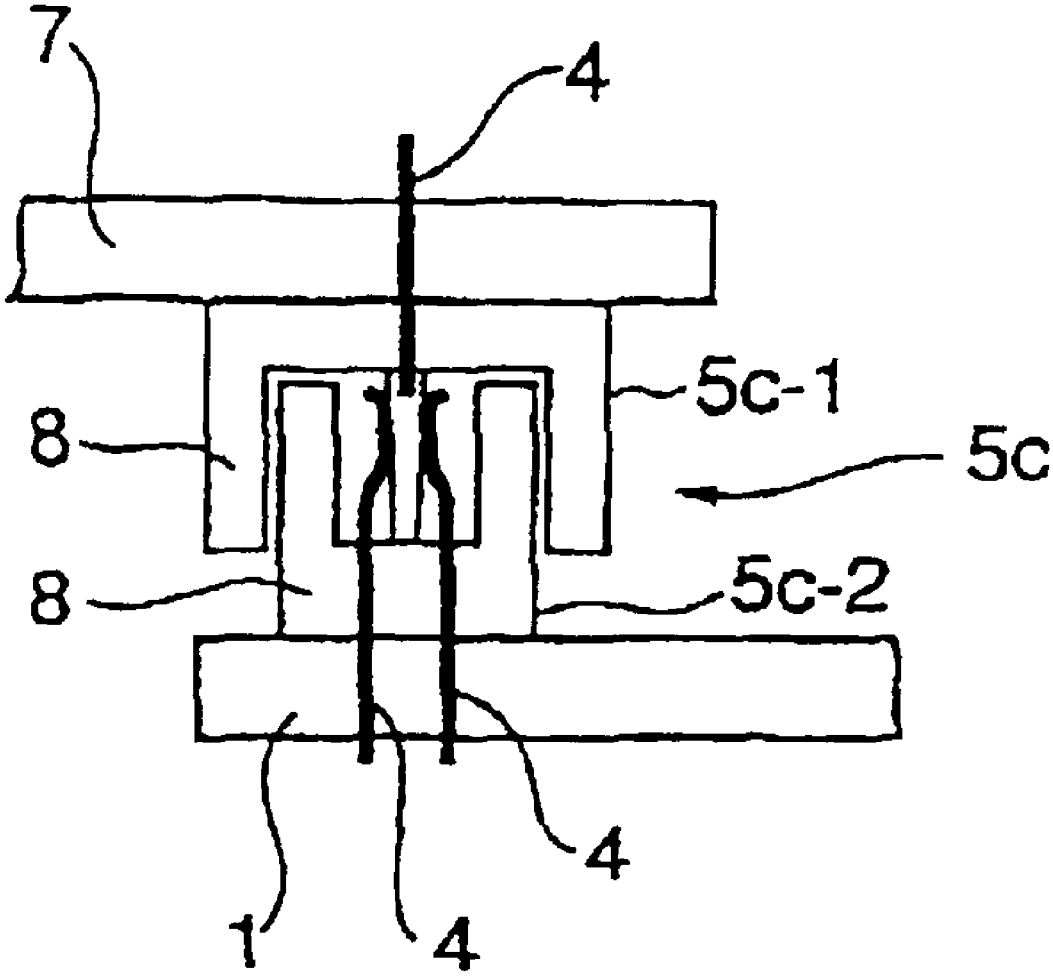
FIG.3 PRIOR ART
FIG. 3 is a schematic diagram showing the general structure of a conventional two piece type connector.
Figure 4:
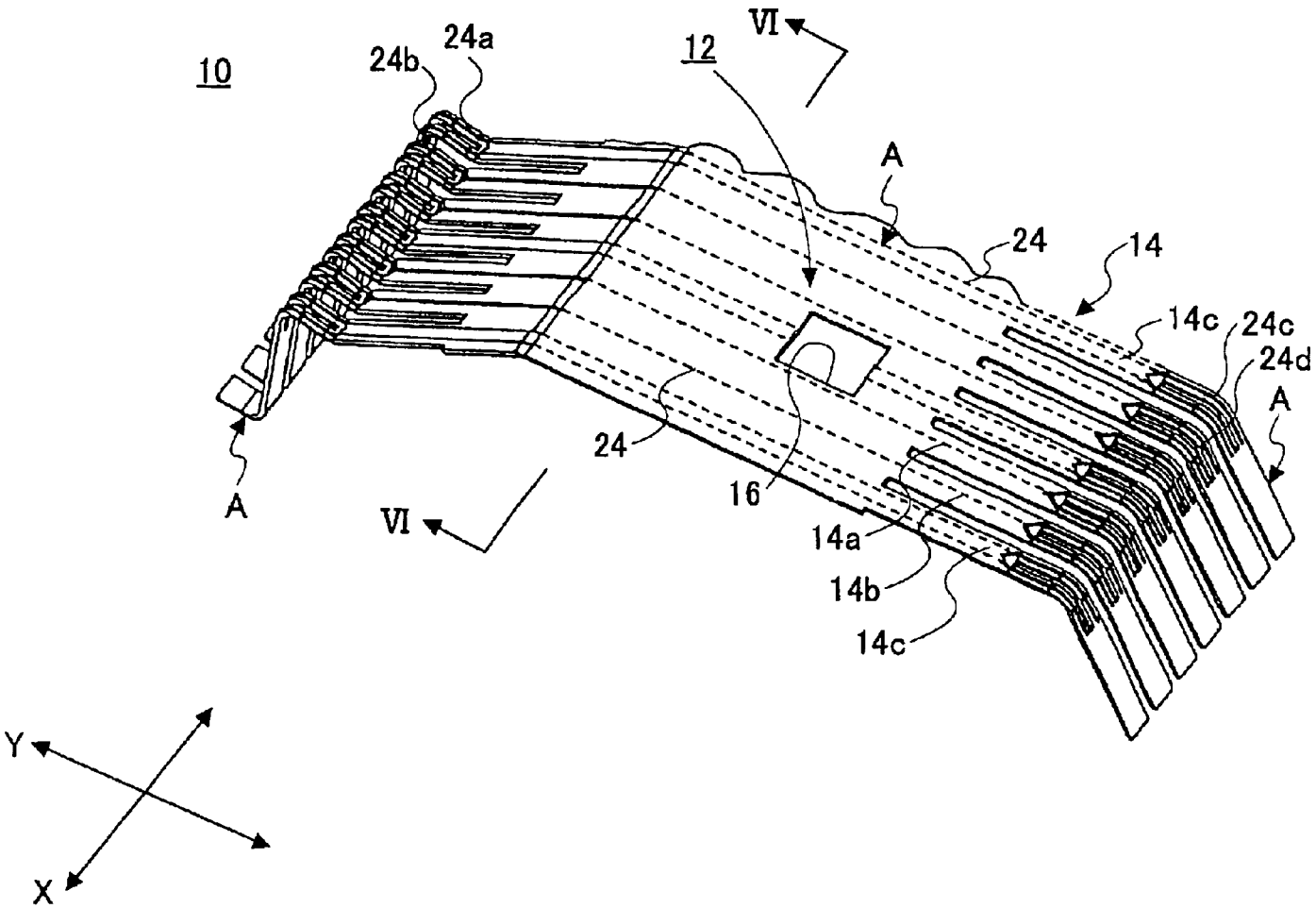
FIG. 4 is a partial perspective view of a contact module according to embodiments of the present invention.
Figure 5:
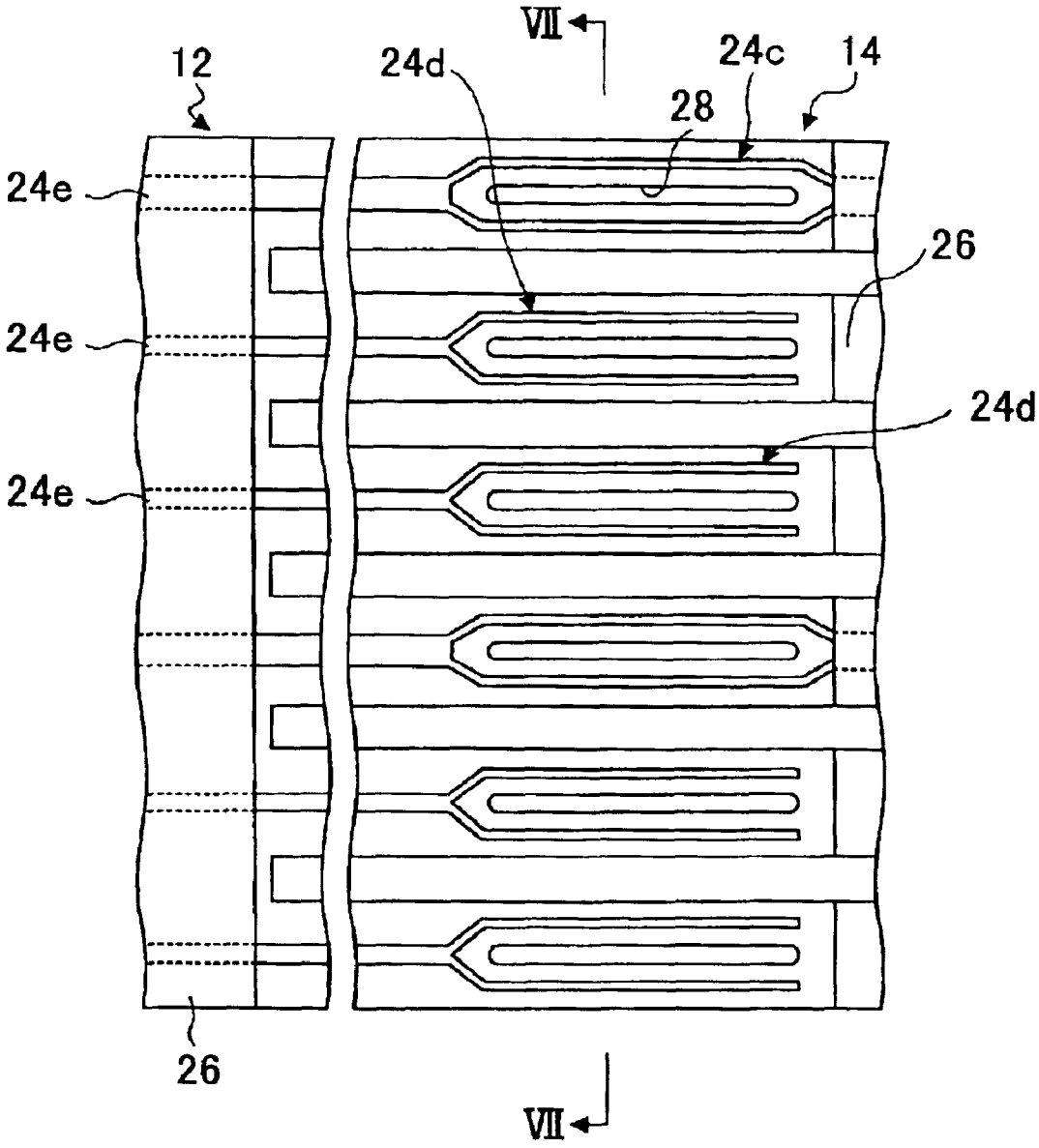
FIG. 5 is a segmented view showing contact portions and the vicinity of the contact module in FIG. 4 in an enlarged manner.
Figure 6:
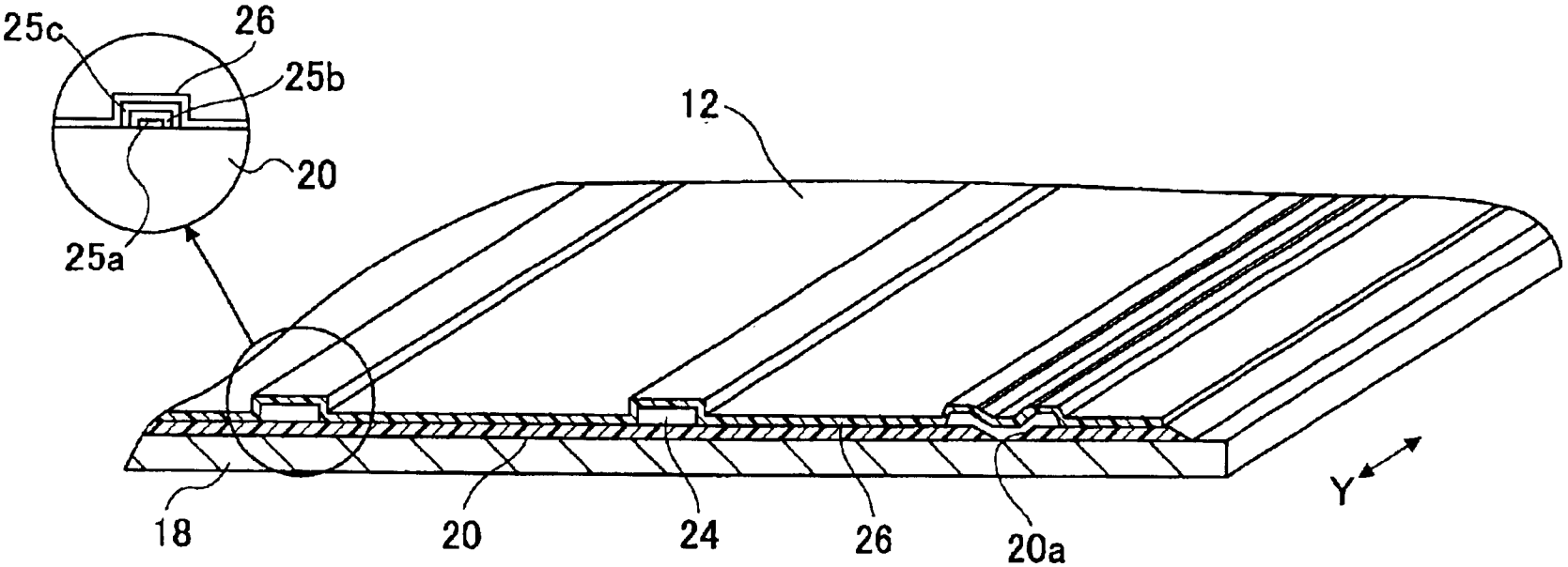
FIG. 6 is a segmented view showing a cross section of the contact module in FIG. 4 taken along line VI—VI.
Figure 7:
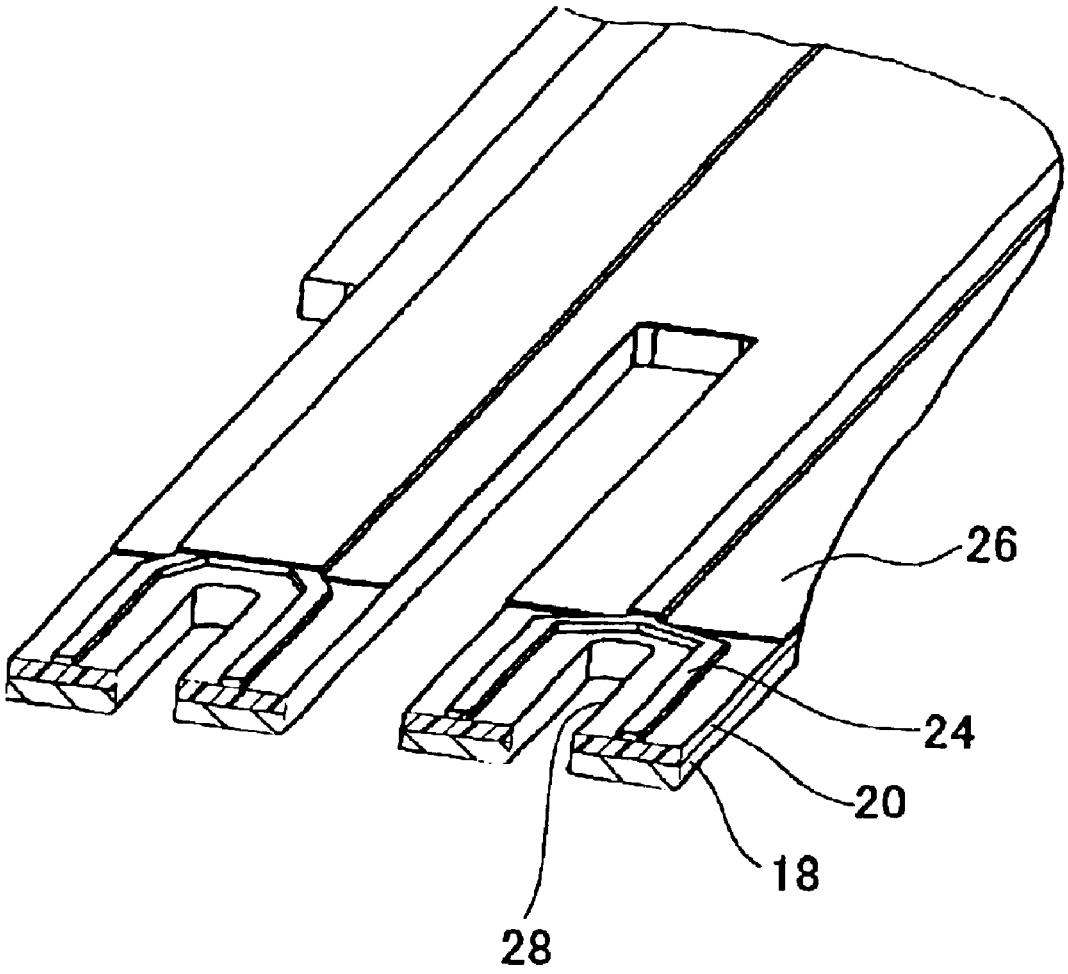
FIG. 7 is a segmented view showing a cross section of the contact module in FIG. 5 taken along line VII—VII.

First, a description will be given of contact modules attached to the connector according to the embodiments, by referring to FIGS. 4 through 7. FIG. 4 is a partial perspective view of the contact module. FIG. 5 is an enlarged segmented view showing contact portions (contact points) of contacts of the contact module. FIG. 6 is a segmented view of the contact module in FIG. 4 taken along line VI—VI. FIG. 7 is a segmented view of the contact module in FIG. 5 taken along the line VII—VII.

A contact module 10 according to the embodiments includes a base 12 formed into a strip-like shape in the directions indicated by X in FIG. 4 and protrusions (teeth of comb-like parts) extending from both sides of the base 12 in the directions indicated by Y in FIG. 4. The base 12 and the protrusions construct a plurality of contacts 14. The contacts 14 on one side are bent to form multistages, and those on the other side are bent into substantially "L" shapes.

In this case, the contact module 10 is preferably used for balanced transmission. In addition, in the contact module 10, a pair of two contacts (designated by reference numerals 14*a* and 14*b* in FIG. 4) arranged side-by-side transmit positive and negative signals having symmetric waveforms. A plurality of pairs of the contacts 14*a* and 14*b* are arranged at a regular interval. A contact 14 (designated by reference numeral 14*c* in FIG. 4) arranged between one pair of the contacts 14*a* and 14*b* and the adjacent pair of the contacts 14*a* and 14*b*, that is, arranged every third contact, is used for grounding. A plurality of rectangular holes 16 (only one hole 16 is shown in FIG. 4) are formed in the base 12. The roles of the holes 16 will be described later.

As shown in FIG. 6, the contact module 10 possesses a stacked structure as a cross-section structure of the contact 14, where a base insulating film 20, a plating film 24 and a cover insulating film 26 are stacked on a sheet 18 in this order. Further, the cover insulating film 26, which forms the outermost surface layer, is provided only for the part of the contact 14 which part corresponds to the base 12 and parts (indicated by arrows A in FIG. 4) on both sides of the contact 14 in the longitudinal direction. In the other parts (a contact portion and the nearby part that will be described later) of the contact 14, the plating film 24 is exposed therefrom, or the base insulating film 20 is exposed with respect to a part where the plating film 24 is not formed. In addition, the cover insulating layer 26, which forms the outmost surface layer, may be omitted.

The plating film 24 is formed by a metal material. The metal material may be a single noble metal, a plurality of noble metals, or further, a stacked metal structure. Here, the plating film 24 is formed with a three-layer structure where a copper plating film 25*a*, a nickel plating film 25*b* and a gold plating film 25*c* are stacked in this order on the base insulating layer 20. The electric characteristics, corrosion resistance and lubricating property are secured by the copper plating film 25*a* and gold plating film 25*c*, and abrasion resistance is secured by the nickel plating film 25*b*. The thickness of the plating film 24 is approximately 14 $\mu$m in total, for example, and the thickness of the copper plating film 25*a* is approximately 12 $\mu$m, for example.

Additionally, the stacked structure slightly differs depending on the kind of the contact 14. That is, as described above, with respect to the contacts 14*a* and 14*b*, the plating film 24 having the predetermined size is formed on the base insulating layer 20. With respect to the contact 14*c*, however, the plating film 24 contacts the sheet 18 since a slit-shaped hole (long groove) 20*a* is formed in the base insulating film 20 in the longitudinal directions of the contact, which are the directions indicated by Y in FIG. 6, in the part of the base 12, that is, the part of a circuit pattern 14*e* that will be described later, and the plating film 24 is formed in the hole

20*a*. In this case, generally, adhesion between the plating film 24 and the sheet 18 is not good. However, the peripheral parts of the plating film 24 contact the walls of the hole constituting the hole 20*a* that are formed into slant faces with good adhesion. Accordingly, the plating film 24 is not separated from the sheet 18.

The sheet 18 gives a certain amount of strength to each contact 14 and the contact module 10 and also gives spring characteristics to the contacts 14 as the base of the stacked structure. The sheet 18 is formed by a metal material. An SUS material may be used for the metal material, for example. It is preferable that copper alloy be used instead of the SUS material in view of electric conductivity. The thickness of the sheet 18 is approximately 50 μm, for example.

The base insulating film 20 is for insulating the sheet 18 and the plating film 24. In addition, the cover insulating film 26 is for protecting the plating film 24. The base insulating film 20 and cover insulating film 26 are formed by an insulating resin material, for example. Preferably, polyimide resin may be used for the insulating resin material. Further, polyethylene terephthalate resin, epoxy resin and the like may also be used for the insulating resin material. Additionally, instead of the insulating resin material, an insulating material such as an inorganic material may be used for the base insulating film 20 and cover insulating film 26. The thickness of the base insulating film 20 is approximately 18 μm, for example, and the thickness of the cover insulating film 26 is approximately 3 μm, for example. Further, a base plating film may be provided between the base insulating film 20 and the plating film 24 according to need. The base plating film is for increasing the adhesion of the plating film 24 and is formed by using a conductive metal material such as copper, for example.

Regarding the plating film 24, the above-described bent parts on both sides of the contacts 14 constitute the contact portions 24*a* through 24*d*. In addition, the parts between the contact portions 24*a* and 24*c* and between the contact portions 24*b* and 24*d* are the circuit patterns 24*e* and serve as such as signal lines. With respect to the contacts 14*a* and 14*b*, the contact portions 24*b* and 24*d* and the circuit pattern 24*e* are formed with substantially the same width, approximately 30 μm, for example. On the other hand, with respect to the contact 14*c*, the contact portions 24*a* and 24*c* are formed with the same width as those of the contact portions 24*b* and 24*d*. The circuit pattern 24*e* is, however, formed wider than the contact portions 24*a* and 24*c*.

Further, each of the parts of the plating film 24 which parts correspond to the contact portions 24*a* through 24*d* is formed to be biforked to both sides of the hole 28 formed to extend in the longitudinal direction of the contact.

The contact module 10, which is constructed as described above, can be manufactured by stacking, cutting and bending each of the films using the technique for manufacturing a suspension of a head part of a hard disk drive device, for example.

A description will be given of the connector according to a first embodiment using the above-described contact module 10, with reference to a longitudinal cross-sectional view of the connector of FIG. 8.

Figure 8:
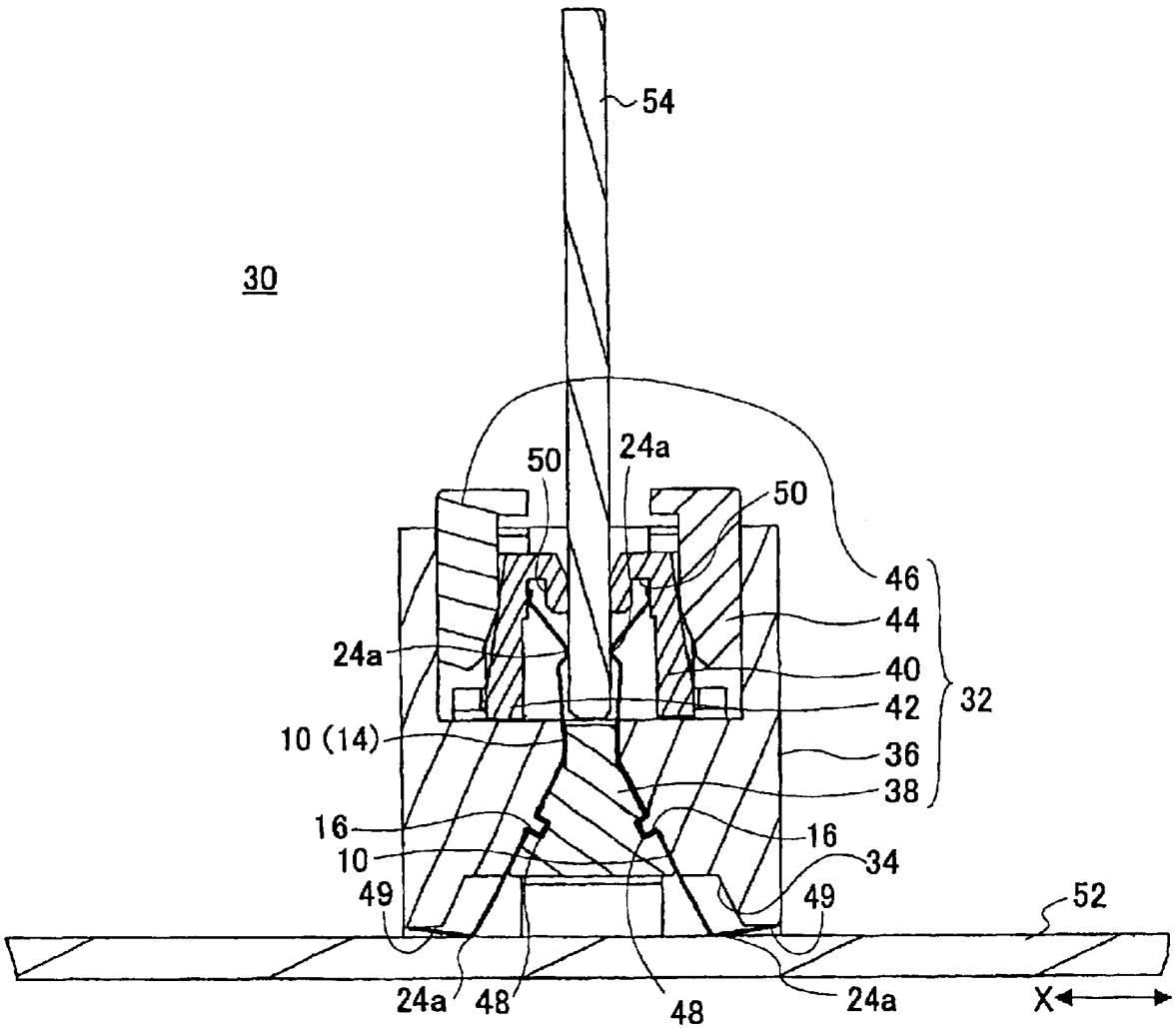
FIG. 8 is a cross-sectional view of the connector according to a first embodiment and boards connected to the connector.

As shown in FIG. 8, a connector 30 according to the first embodiment includes the contact modules 10 and a connector body 32 to which the contact modules 10 are attached.

The connector body 32 includes a cuboid-like housing 36, a supporting member (supporter) 38 having a substantially trapezoid cross section in the longitudinal direction, and a pair of slider members 40 and 42, and a pair of fitting members (pushers) 44 and 46. The slider members 40 and 42 and the fitting members 44 and 46 form a press member of the present invention (refer to FIG. 16 for the outer shape of each member).

An opening 34 is formed inside the housing 36. Protrusions 48 are formed on the lower parts of the inner walls forming the opening 34. In addition, concave parts 49 are formed at the bottom of the housing 36 in continuation with the opening 34. The tops of the slider members 40 and 42 are folded in U-shapes, and concave parts 50 are formed inside the U-shape parts.

A pair of the contact modules 10 are attached so as to face the inner walls of the opening 34 of the housing 36. The supporting member 38 is fit in the lower part of the opening 34 of the housing 36, and the lower parts of the contact modules 10 are fixed in between the housing 36 and the supporting member 38.

The top parts of the upper side contact portions 24*a* through 24*d* (hereinafter all the contact portions are simply referred to as the contact portions 24 for convenience) are caught by the concave parts 50 of the slider members 40 and 42. The slider members 40 and 42 are arranged on the rear sides of the contact modules 10 such that the slider members 40 and 42 can move in the directions indicated by X in FIG. 8.

The fitting parts 44 and 46 are arranged in the spaces between the housing 36 and the slider members 40 and 42, respectively.

The connector 30 is placed on a board 52 with the lower side contact portions 24*a* being connected to terminals (pads) (not shown) of the board (mother board) 52. Also, one end of a board (daughter board) 54 is held between the upper side contact portions 24*a* via terminals (pads) (not shown). Thus, the boards 52 and 54 are electrically connected via the connector 30.

A description will be given of an assembly method of the connector 30, with reference to FIGS. 9 through 13.

Figure 9:
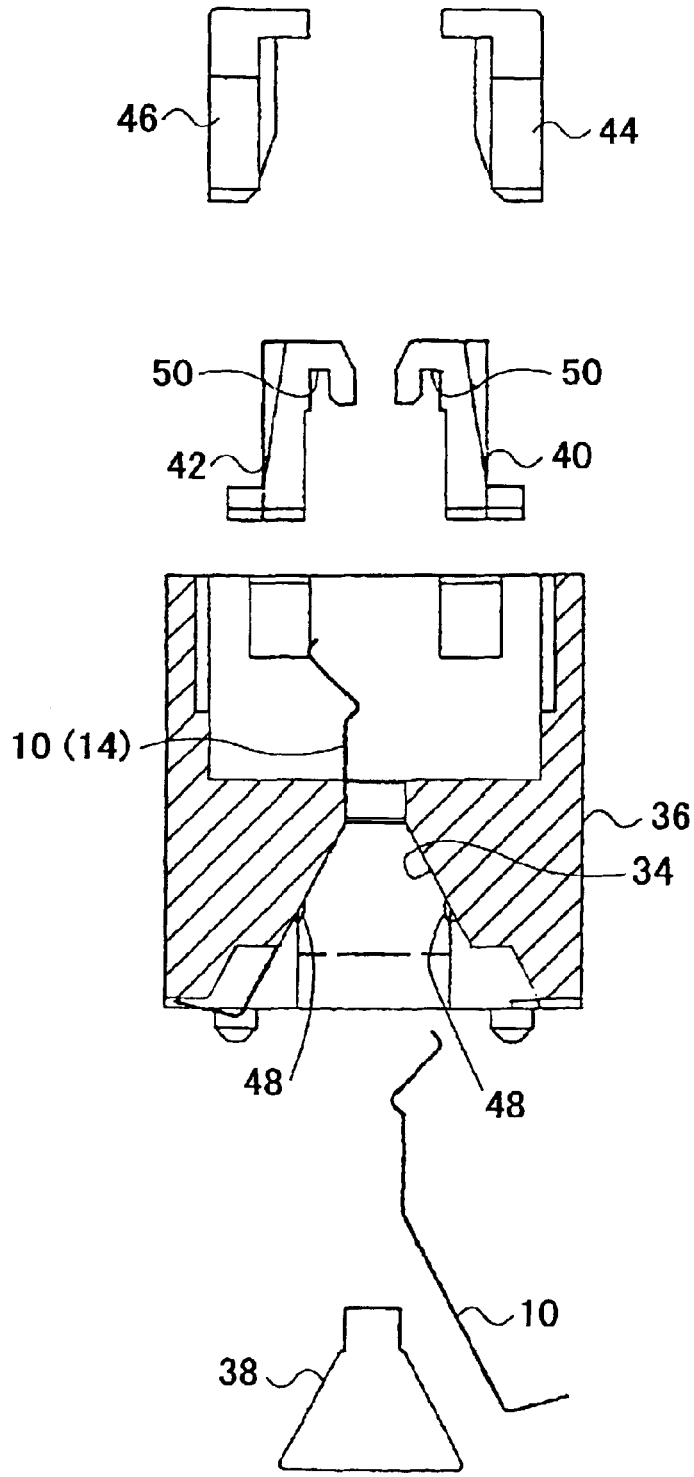
FIG. 9 is an exploded assembly drawing of the connector for explaining an assembly method of the connector in FIG. 8.
Figure 10:
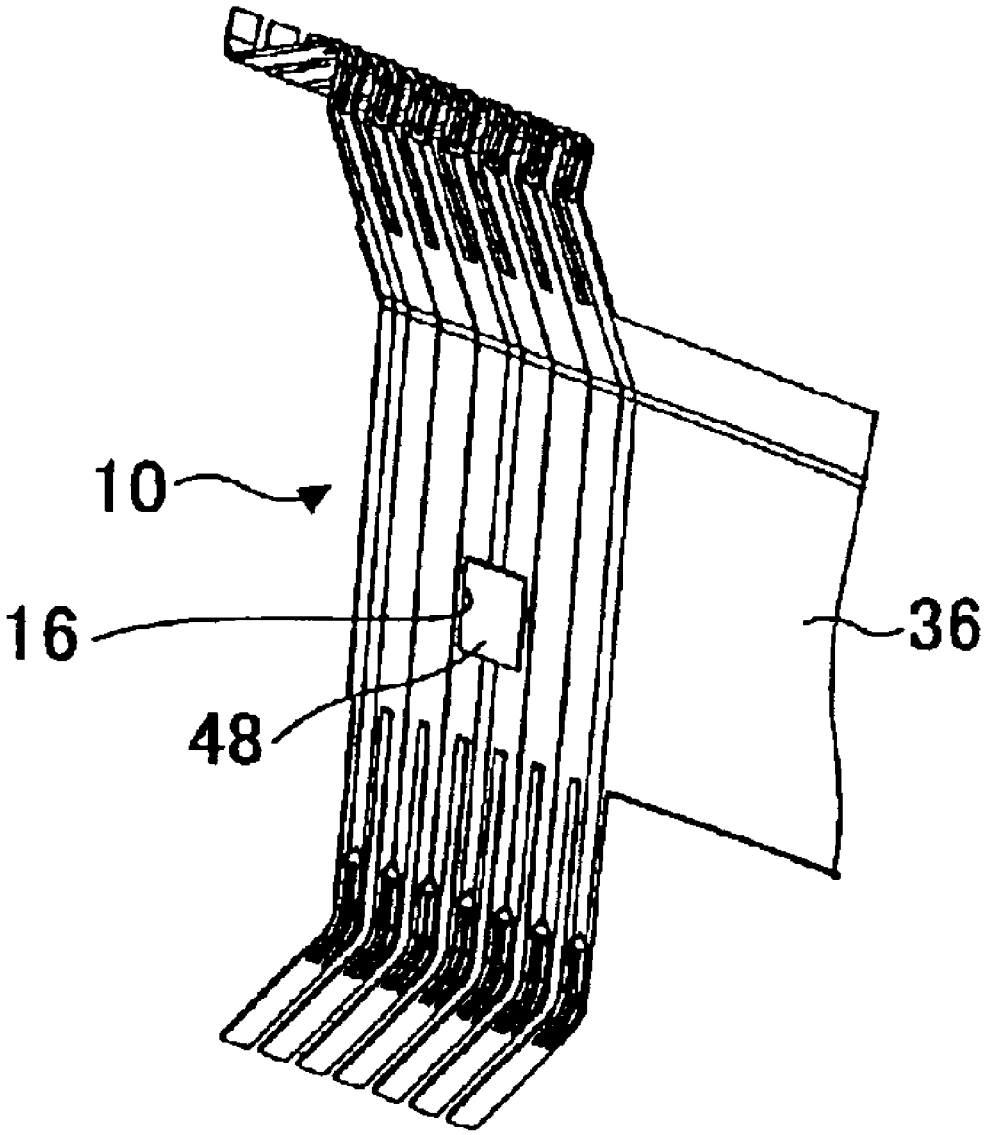
FIG. 10 is an enlarged view of a contact module attaching part for explaining the assembly method of the connector in FIG. 8.

First, the pair of the contact modules 10 is attached to the housing 36. FIG. 9 shows a state where one of the contact modules 10 is attached to the housing 36. On this occasion, as shown in FIG. 10, the hole 16 of the contact module 10 is caught, positioned and temporarily fixed by the protrusion 48 provided on the inner wall of the housing 36.

Figure 11:
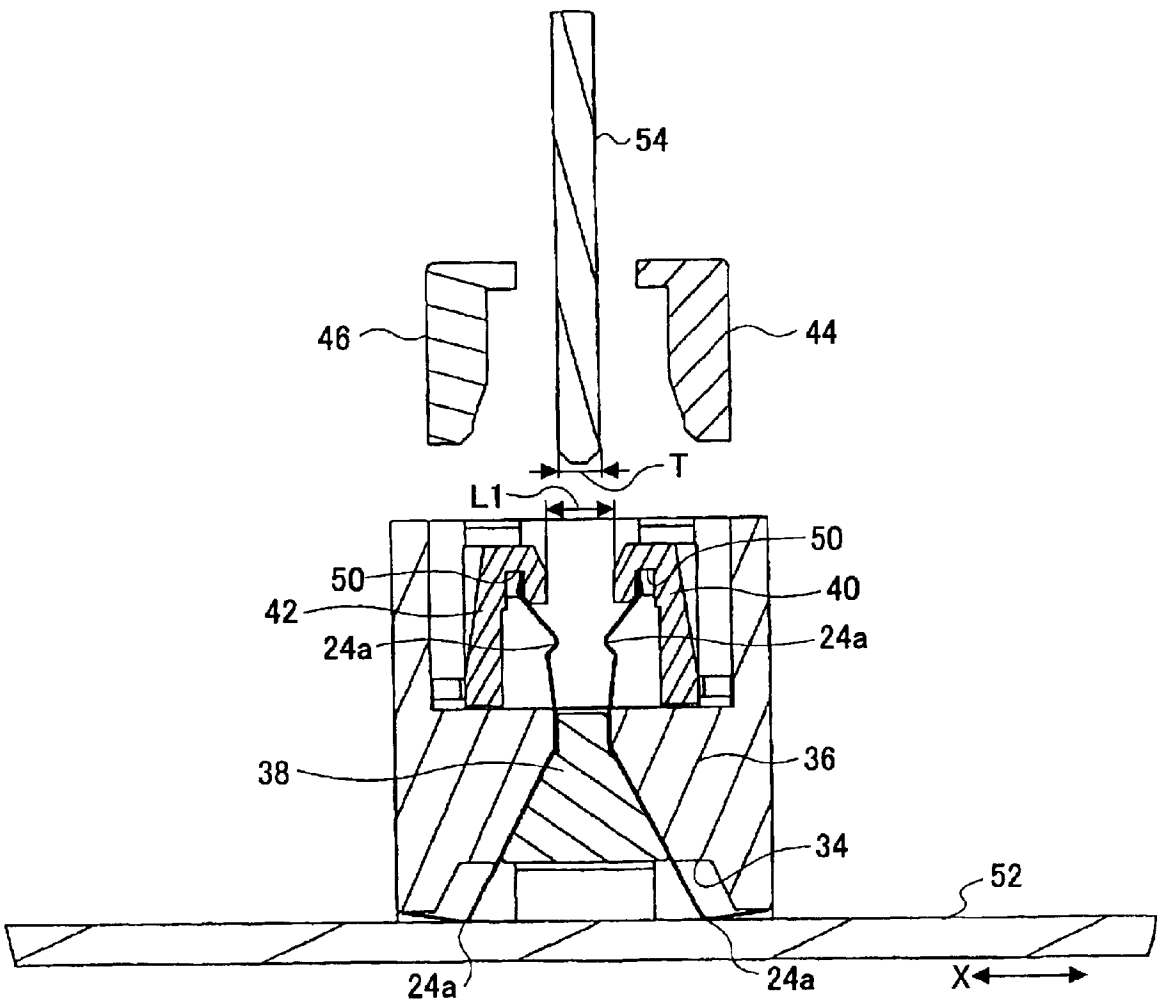
FIG. 11 is a schematic diagram showing a state up to where slider members are mounted for explaining the assembly method of the connector in FIG. 8.

Then, as shown in FIG. 11, the supporting member 38 is fit in the lower part of the opening 34 of the housing 36, and the contact modules 10 are held and fixed between the housing 36 and the supporting member 38.

Figure 13A:
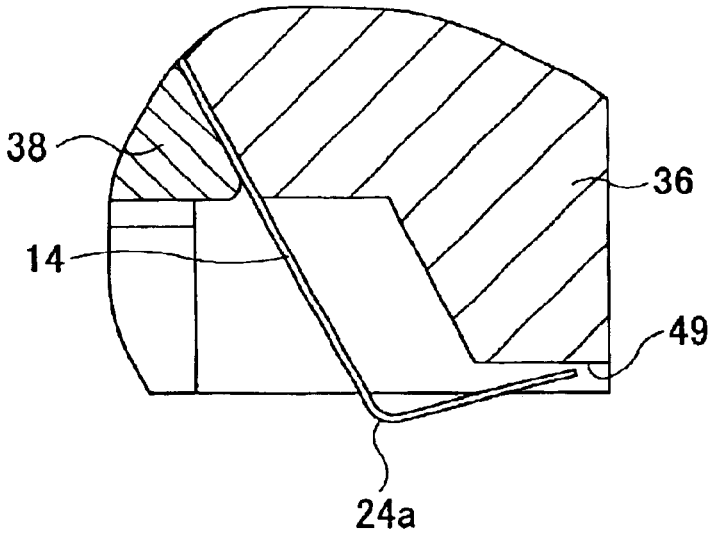
FIG. 13A is a schematic diagram showing the shape of the contact before the connector is connected to a board placed horizontally for explaining the assembly method of the connector in FIG. 8.
Figure 13B:
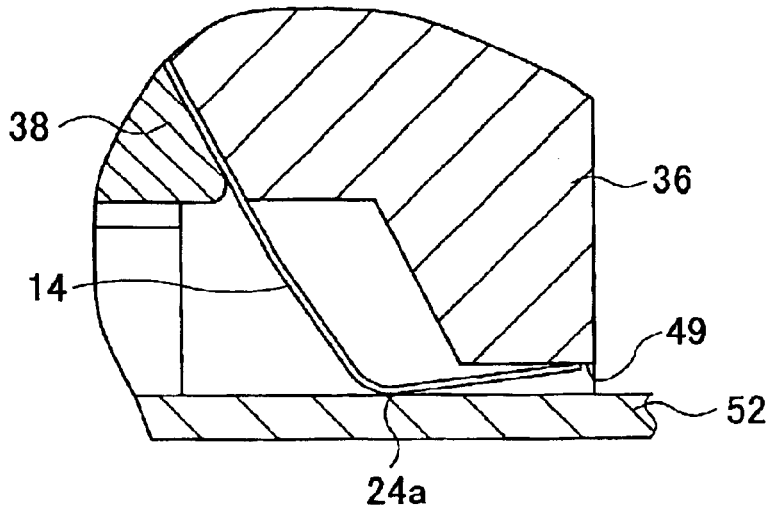
FIG. 13B is a schematic diagram showing the shape of the contact in a state where the connector is connected to the board placed horizontally.

In this state, the housing 36 is fixed to the board 52 by using appropriate means while making the lower side contact portions 24*a* contact the terminals of the board 52. On this occasion, as shown in FIG. 13A, before the connector 30 is mounted to the board 52, the top parts of the lower side contact portions 24 bent in substantially L-shapes extend downward in FIG. 13A from the bottom surface of the connector 30. In addition, the lower tips of the contacts 14 are not fixed to the housing 36, that is, they are free ends. Then, as shown in FIG. 13B, when mounting the connector 30 to the board 52, the corner parts of the contact portions 24*a* contact and are pressed against terminals (not shown) formed on the board 52. Hence, the contacts 14 are deformed such that the entire L-shape parts of the contact portions 24*a* are bent, and the lower tips of the contacts 14 move rightward in FIG. 13B inside the concave parts 49. Thus, the press force is reduced, that is, the contact force between the terminals of the boards 52 and the contact portions 24*a* of the contacts 14 is adjusted to a moderate magnitude.

Further, the slider members 40 and 42 are inserted in the rear sides of the respective contact modules 10. The upper tips (in other words, the upper tips of the contact portions 24*a*) of the contacts 14 of the contact modules 10 are caught by the respective concave parts 50 of the slider members 40 and 42. On this occasion, since there are spaces between the inner walls of housing 36 and the backs of the slider members 40 and 42, the slider members 40 and 42 are arranged such that the slider members 40 and 42 can move in the directions indicated by X in FIG. 11. Then, the slider members 40 and 42 are moved to both sides (made distant from each other) so that a distance L1 between the facing contact portions 24*a* of the contacts 14 caught by the slider members 40 and 42 is greater than a thickness T of the board 54.

Figure 12:
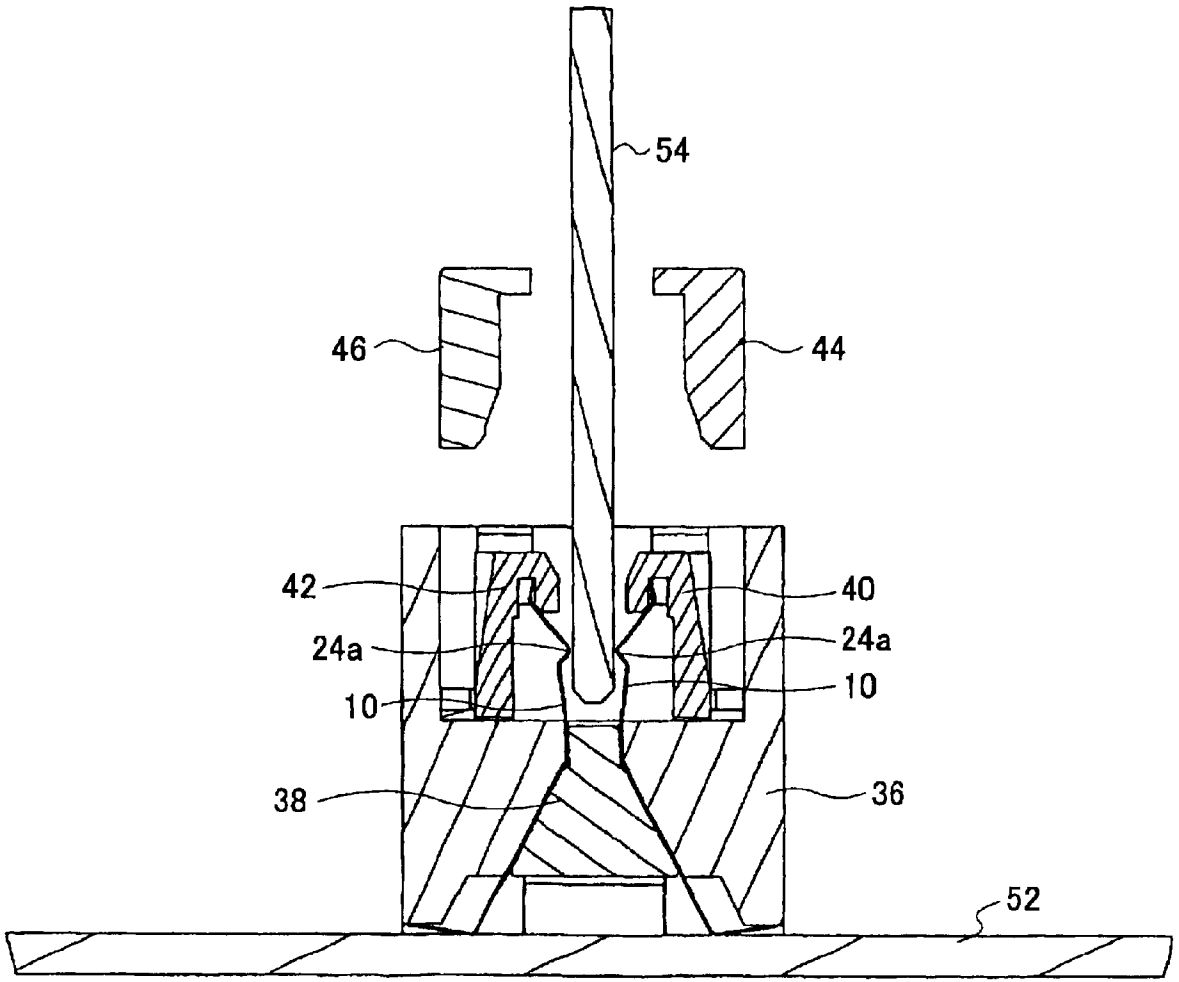
FIG. 12 is a schematic diagram showing a state where a board is inserted from above for explaining the assembly method of the connector in FIG. 8.

Thereafter, as shown in FIG. 12, the end of the board 54 is inserted between the upper facing contact portions 24*a*. On this occasion, the board 54 is inserted such that the board 54 does not contact the contact portions 24*a*.

Last, the fitting members 44 and 46 are inserted in the spaces between the inner walls of the housing 36 and the backs of the slider members 40 and 42, respectively. At this moment, the slider members 40 and 42 are pressed by the fitting members 44 and 46, respectively. Thus, the slider members 40 and 42 are slid, and the facing contact portions 24*a* are pressed against the terminals of the board 54. Hence, moderate contact force is obtained between the contact portions 24 and the terminals. That is, the ZIF structure is achieved.

On this occasion, even if excessive force is applied to the contact portions 24*a* for some reason, the upper tips of the contacts 14 are bent inside the concave parts 50, and thereby the force is reduced. Thus, the contact force is adjusted.

Further, on this occasion, the upper parts, that is, the uniform parts of the slider members 40 and 42 are pressed against the board 54 by the fitting members 44 and 46, respectively. Hence, the board 54 is positively held by the connector 30.

Accordingly, the structure as shown in FIG. 8, where the boards 52 and 54 are electrically connected via the connector 30, is obtained.

A description will be given of an example of data of the electric characteristics of the connector 30.

Figure 14:
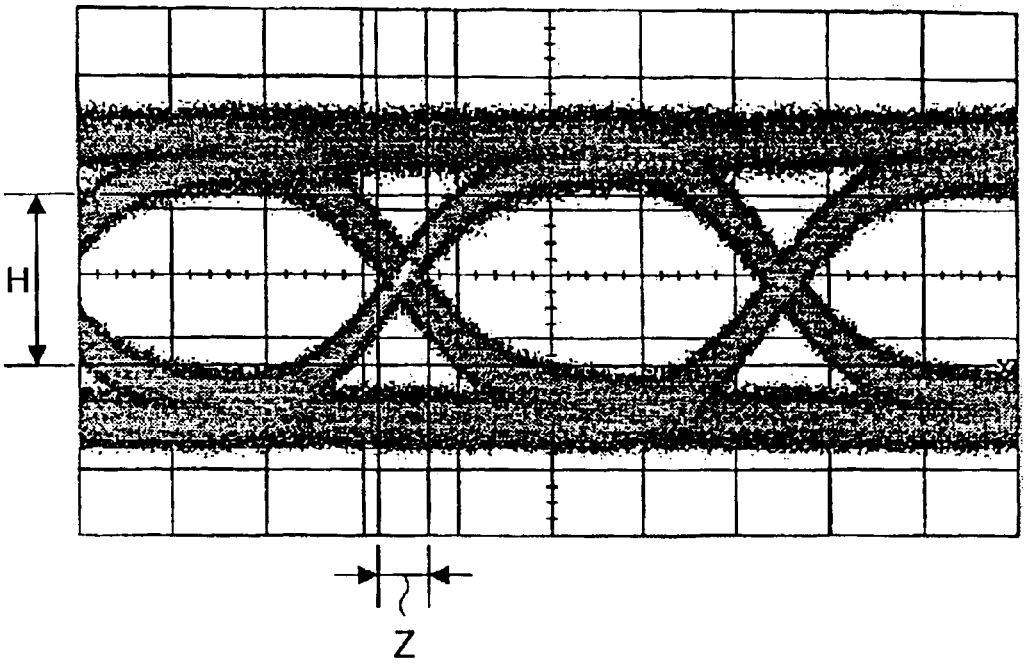
FIG. 14 is a schematic diagram showing an eye pattern of the connector in FIG. 8.

The eye pattern obtained by sending random signals to the connector 30 and recording the waveform was measured as shown in FIG. 14 in a case of 5 Gbps. An eye height H is 502.5 mV and jitter Z is 27 ps. The eye part is not distorted and a clear shape is observed.

The contact module 10 is mounted in the connector and provides the following advantages.

First, in the contact module 10, the contacts 14 include the sheet 18 having a predetermined thickness as a base part. Thus, it is possible to easily give spring characteristics to the contacts 14. Also, since the contacts 14 can be bent, it is possible to insert the contacts 14 into another member, insert another member between the respective contacts 14 of a pair of the opposing contact modules 10, and to obtain contact force after the insertion by restoring force of the contacts 14. Such effects may be obtained when, for example, both ends of the contact modules 10 are directly mounted to the housing, for example.

Additionally, in the connector 30 according to the first embodiment, the contact module 10, that is, the contacts 14, are formed to be thin and large numbers of the contacts 14 are arranged with a narrow pitch. Thus, it is possible to realize a smaller connector and higher-density mounting (narrower pitch mounting) of the contacts. As for the higher-density mounting, the pitch between the contacts may be made as narrow as approximately 0.1 mm, for example.

Also, since the contacts 14 and the part that functions as signal lines and the like are formed by the thin film-like contact portions 24*a* through 24*d* and the circuit patterns 24*e*, it is possible to perform impedance matching with good accuracy.

In addition, in the contact module 10, by making the sheet 18 function as a ground layer, a micro-strip line structure can be formed. Accordingly, crosstalk and noise are reduced.

Moreover, since the circuit patterns 14*e* of the contacts 14 for grounding of the contact module 10 contact the sheet 18 via the holes 20*a*, it is possible to have a more positive ground.

Further, the circuit patterns of the contacts of the contact module are covered with the insulating film and only the contact portions 24*a* through 24*d* are exposed. Thus, compared with a case where the circuit patterns are not covered with the insulating film, when using the connector to which the contact modules 10 are attached, disconnection and the like due to abrasion and damage are prevented even if the circuit pattern part of the contact contacts another member, such as the board.

Additionally, the contact portions 24*a* through 24*d* of the contacts 14 for signals of the contact module 10 are biforked. Thus, when connecting the connector to which the contact modules are attached to such as another electronic component, it is possible to obtain a more positive continuity (connection).

Also, in a case of a conventional connector having a structure where a plurality of contacts are arranged, in a state where the connector is mounted to such as a board, it is difficult to avoid occurrence of differences in transmission distances (wiring lengths) of wiring patterns of the contacts when the contacts are connected to the wiring patterns on the board. This would be a problem especially in a case of balanced transmission, for example. On the other hand, according to the present invention, it is possible to improve the problem by performing adjustment in advance that provides differences in the pattern lengths of the circuit patterns.

In addition, if the adjacent contacts (circuit patterns) are configured to function as a pair of signal lines for balanced transmission, it is possible to preferably reduce crosstalk as in the so-called edge couple in a circuit board. Also, signal coupling can be made as firm as in a circuit board.

Figure 15:
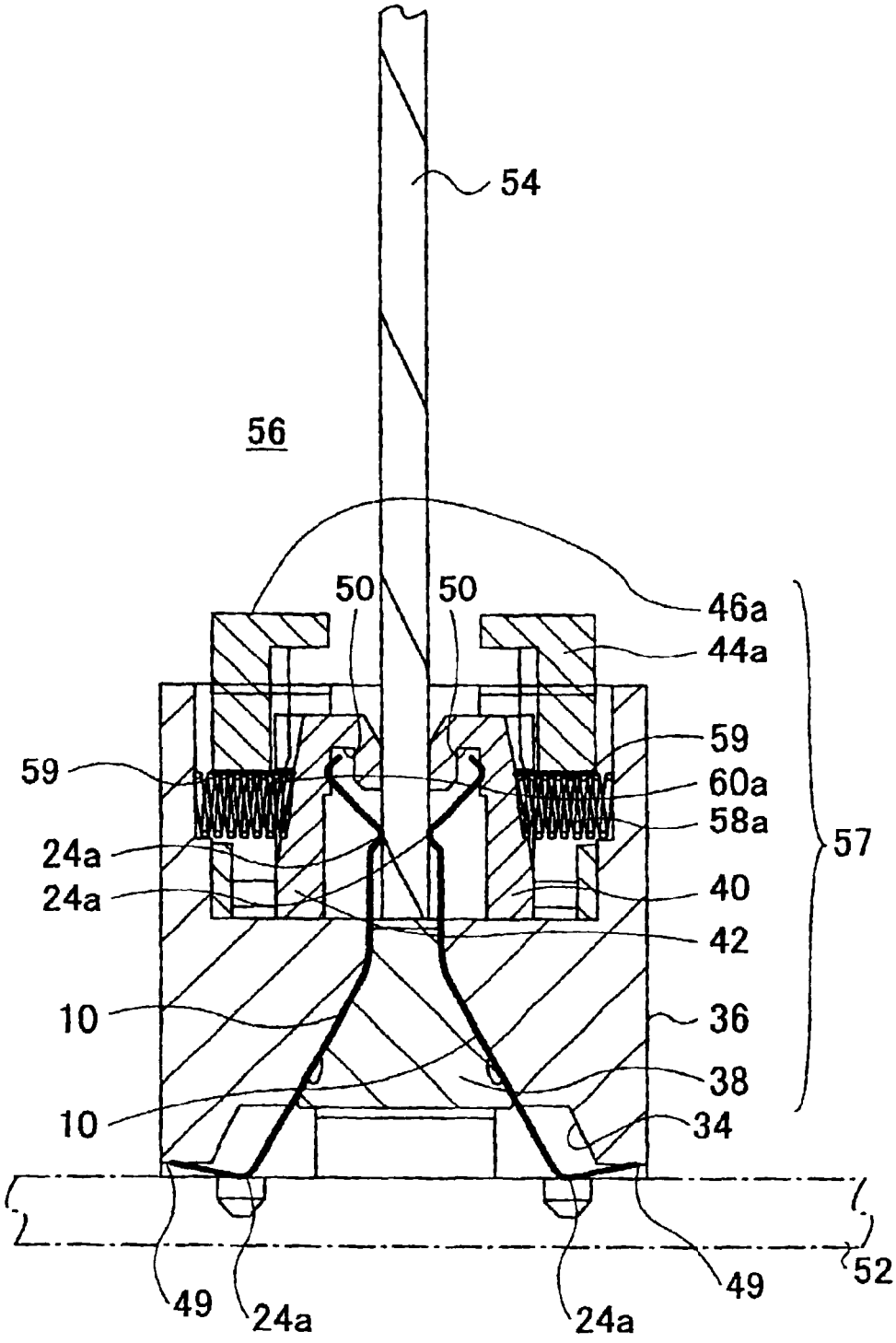
FIG. 15 is a cross-sectional view of the connector according to a second embodiment and boards connected to the connector.

Next, a description will be given of the connector according to a second embodiment, with reference to FIGS. 15 through 19. FIG. 15 is a longitudinal cross-sectional view of the connector in a state where a board is connected thereto. FIGS. 16 through 19 are illustrations for explaining an assembly procedure of the connector.

The basic structure of the connector according to the second embodiment is the same as that of the connector 30 according to the first embodiment. Thus, the same parts are designated by the same reference numerals, and overlapping descriptions will be omitted.

Figure 16:
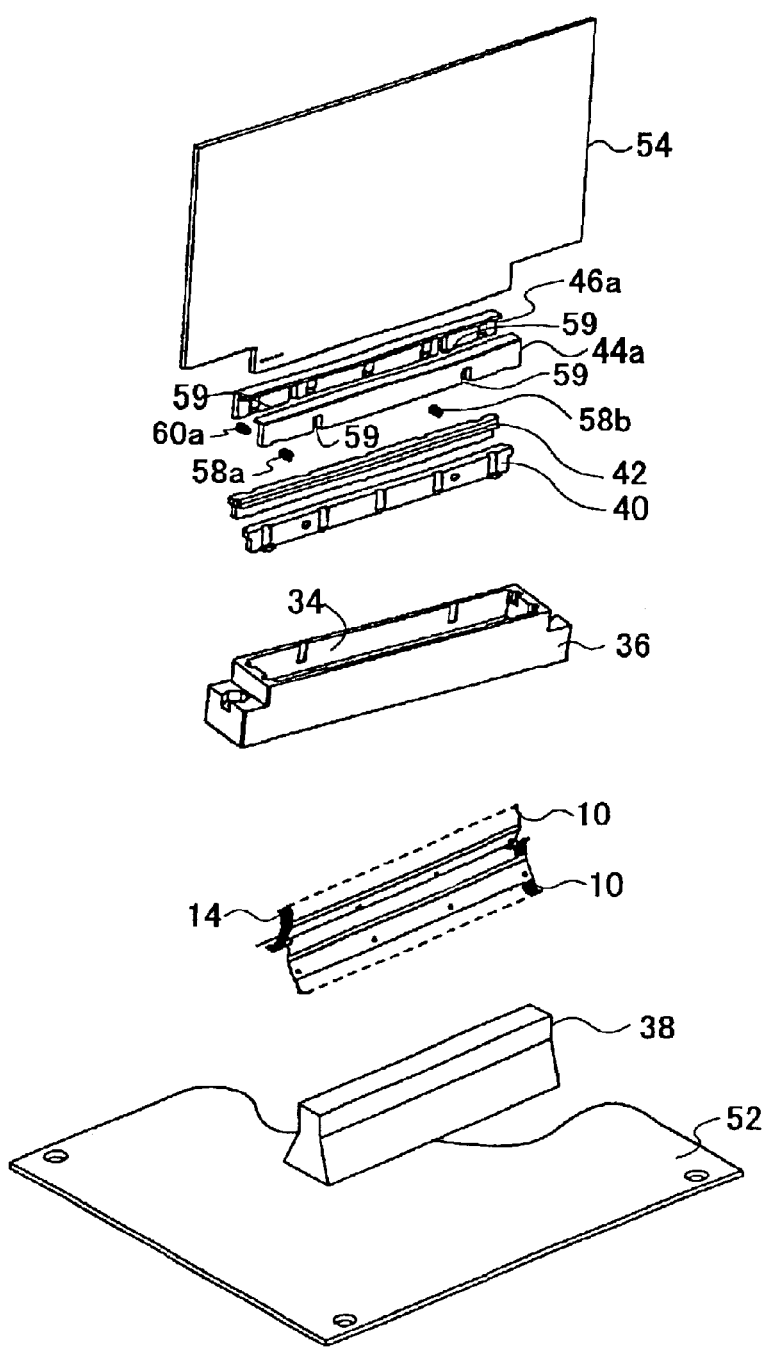
FIG. 16 is an exploded assembly drawing of the connector for explaining an assembly method of the connector in FIG. 15.

As shown in FIG. 15, a connector 56 according to the second embodiment is different from the connector 30 in that the connector 56 includes a pair of slider members 40 and 42, a pair of fitting members 44*a* and 46*a* (corresponding to the fitting members 44 and 46 of the connector 30), and two pairs of coil springs (elastic members) 58*a* and 58*b* and 60*a* and 60*b* as a press member constructing a connector body 57 (in FIG. 16, the coil spring 60*b* is not shown).

A description will be given of the assembly of the connector 56 according to the second embodiment following the assembly procedure.

The assembly procedure of the connector 56 according to the second embodiment is basically the same as that of the connector 30 according to the first embodiment.

Figure 17:
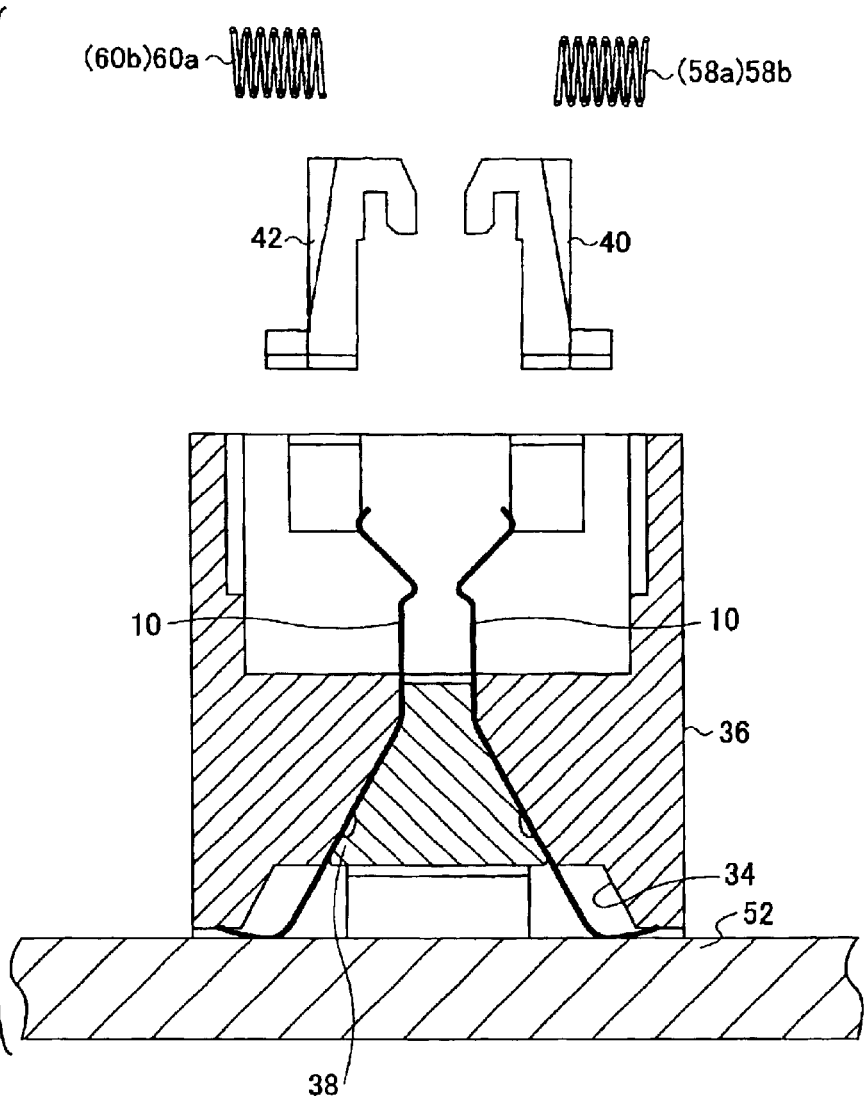
FIG. 17 is a schematic diagram showing a state up to where a supporting member is mounted for explaining the assembly method of the connector in FIG. 15.

As shown in FIG. 17, a pair of the contact modules 10 and the supporting member 38 are attached to the housing 36.

Figure 18:
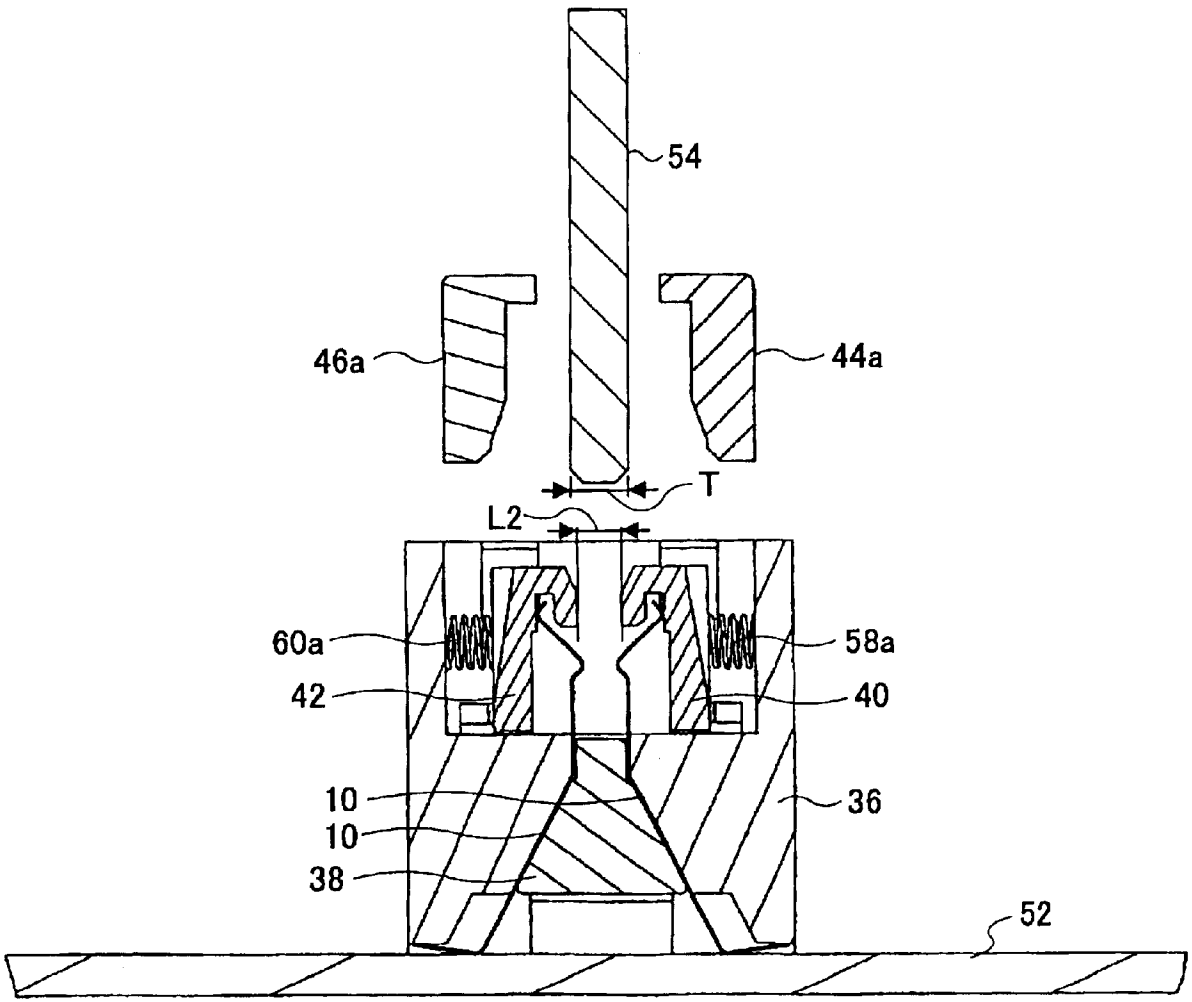
FIG. 18 is a schematic diagram showing a state up to where coil springs are mounted for explaining the assembly method of the connector in FIG. 15.

Then, as shown in FIG. 18, the slider members 40 and 42 are made to catch the tips of the contacts 14 and arranged on the respective back sides of the corresponding contact modules 10. Further, the coil springs 58*a*, 58*b*, 60*a* and 60*b* are installed between the back surfaces of the contact modules 10 and the inner walls of the housing 36. On this occasion, the facing contact portions 24*a* are urged to move and made close to each other by the coil springs 58*a*, 58*b*, 60*a* and 60*b* via the slider members 40 and 42. Thus, a distance L2 between the facing contact portions 24*a* becomes substantially equal to or slightly smaller than a thickness T of the board 54.

Figure 19:
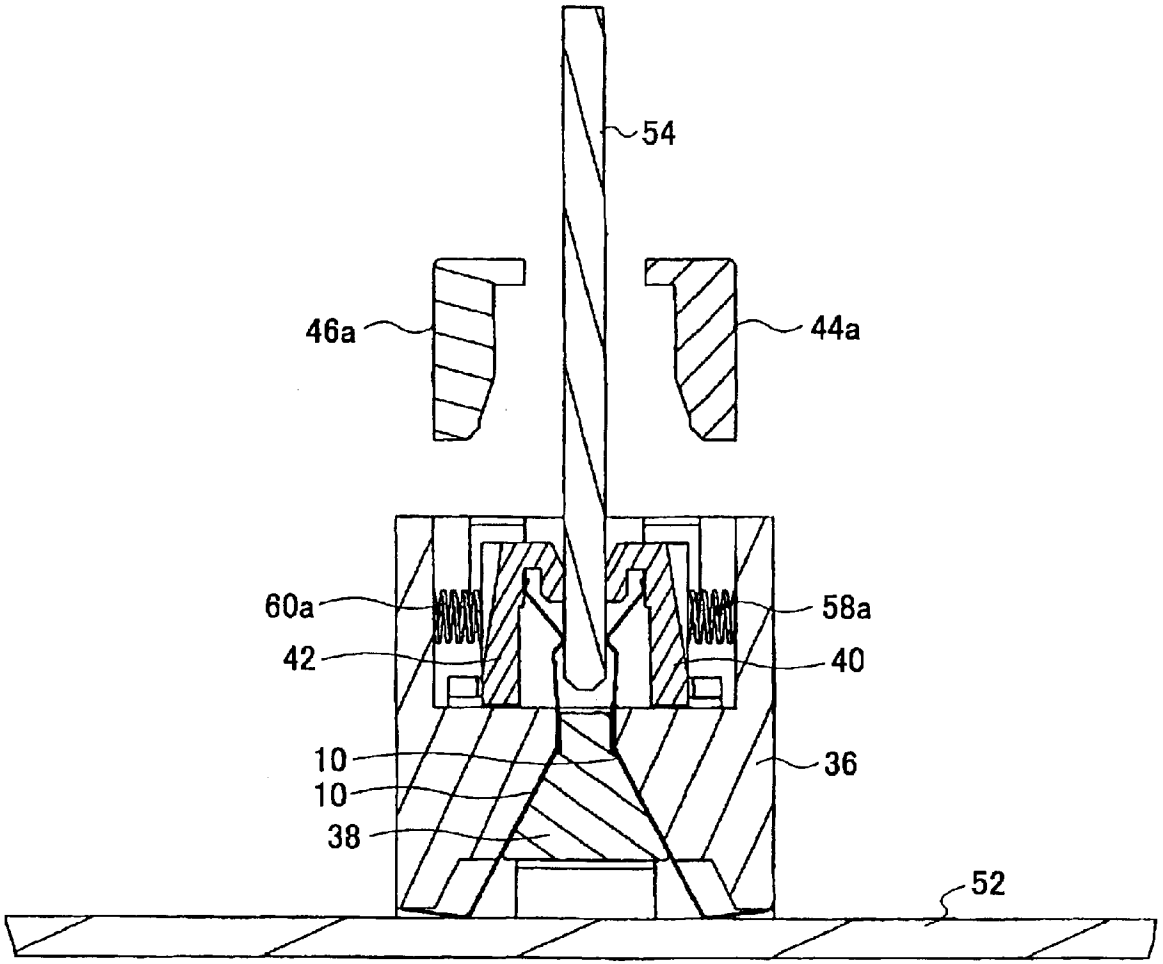
FIG. 19 is a schematic diagram showing a state where a board is inserted from above for explaining the assembly method of the connector in FIG. 15.

Then, as shown in FIG. 19, the end of the board 54 is inserted between the upper facing contact portions 24*a*. On this occasion, the board 54 is inserted while slightly contacting the contact portions 24*a* with low contact pressure. In other words, the LIF structure is achieved. In addition, contamination and the like on the surfaces of the contact portions 24*a* and the surfaces of the terminals of the board 54 are removed (cleaned) by sliding contact between the contact portions 24*a* and the board 54.

Last, the fitting members 44*a* and 46*a* are inserted in the spaces between the inner walls of the housing 36 and the back sides of the slider members 40 and 42, respectively. Hence, the slider members 40 and 42 are pressed and slid by the fitting members 44*a* and 46*a*, respectively, and the contact portions 24*a* are further pressed. Thus, good contact force with the terminals of the board 54 is obtained. Further, on this occasion, since grooves 59 for inserting the coil springs 58*a*, 58*b* , 60*a* and 60*b* are formed in the fitting members 44*a* and 46*a*, the fitting members 44*a* and 46*a* do not interfere with the coil springs 58*a*, 58*b*, 60*a* and 60*b*.

According to the above procedure, the structure as shown in FIG. 15, where the boards 52 and 54 are electrically connected to each other via the connector 56, is obtained.

By using the connector 56 according to the second embodiment, it is possible to obtain effects similar to those of the connector 30 according to the first embodiment.

A description will be given of the connector according to a third embodiment, with reference to FIG. 20.

Figure 20:
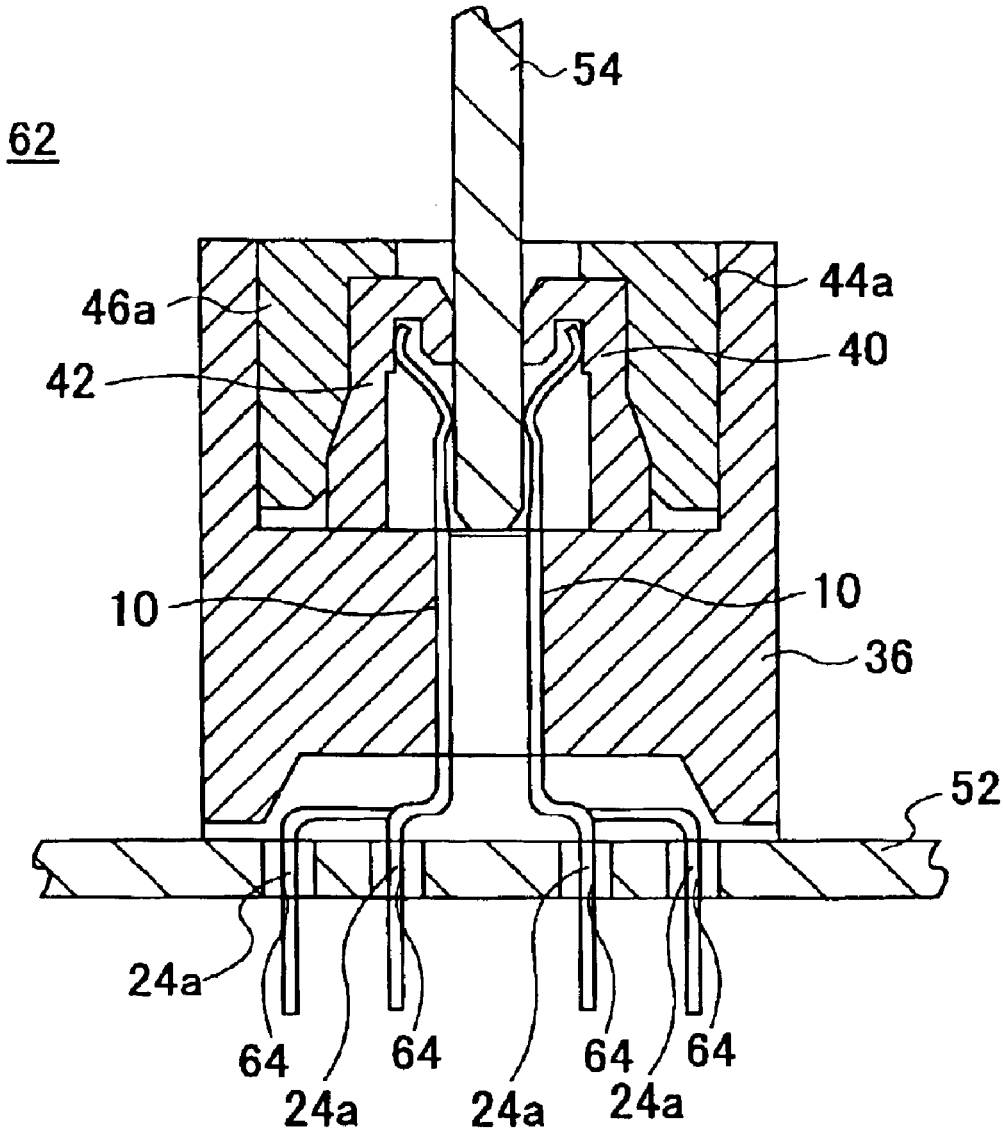
FIG. 20 is a cross-sectional view of the connector according to a third embodiment and boards connected to the connector.

As shown in FIG. 20, the basic structure of a connector 62 according to the third embodiment is substantially the same as that of the connector 30 according to the first embodiment. Thus, the same parts are designated by the same reference numerals, and overlapping descriptions will be omitted.

The connector 62 is different from the connector 30 in regard to the electric connecting structure with the board 52.

In other words, throughholes 64 are formed in the board 52. On the other hand, the parts including the lower contact portions 24*a* of the contact modules 10 are formed into straight shapes (pin shapes). Then, the parts including the contact portions 24*a* are put through the throughholes 64. Since the contact portions 24*a* contact the throughholes 64, positive continuity can be obtained. Also, the connector 62 is positively fixed to the board 52.

Figure 21:
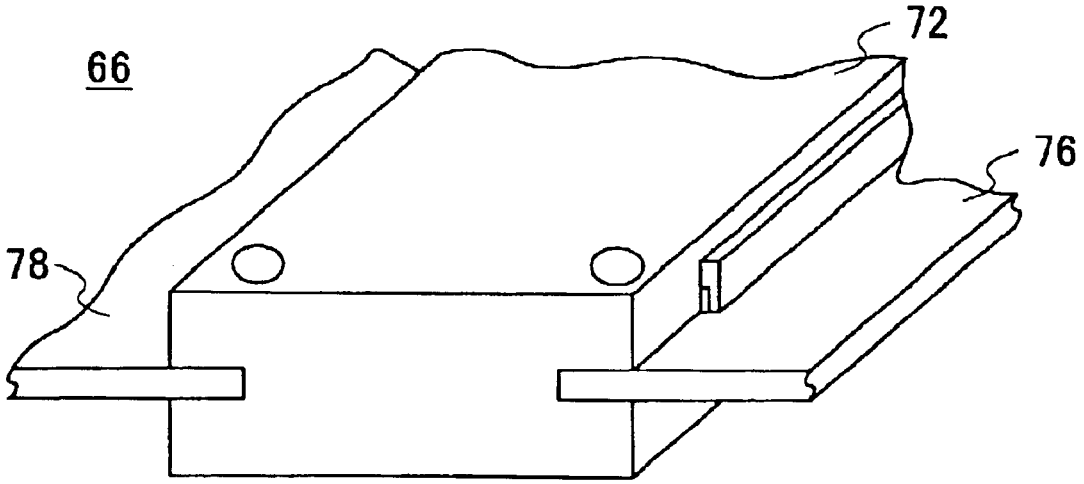
FIG. 21 is a partial perspective view of the connector according to a fourth embodiment and boards connected to the connector.
Figure 22:
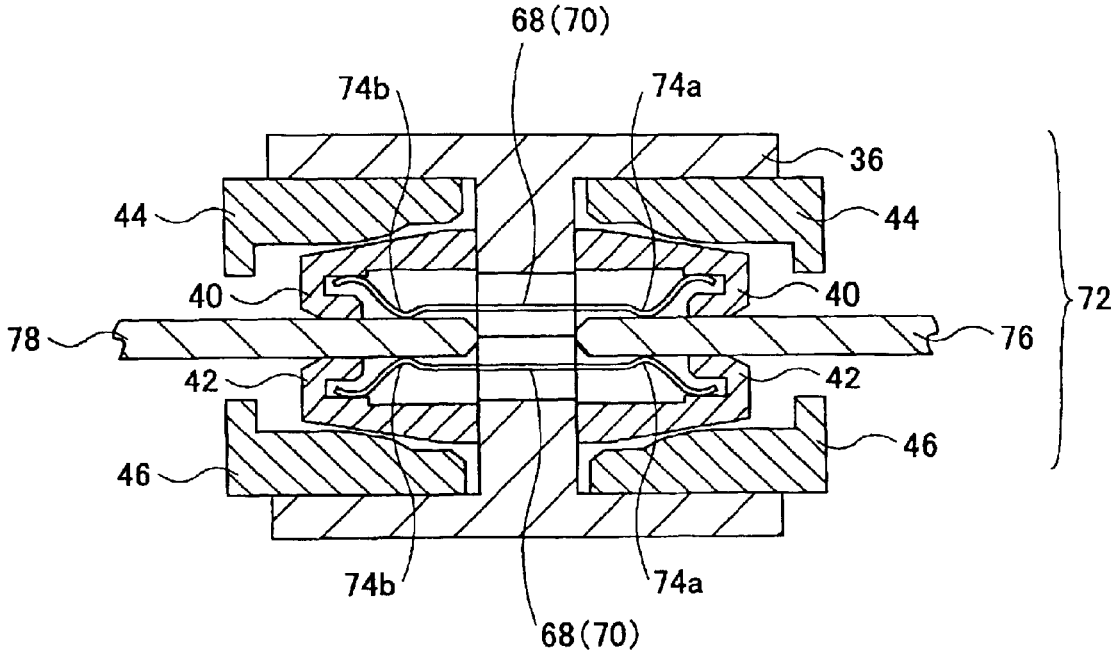
FIG. 22 is a partial cross-sectional view of the connector and the boards connected to the connector in FIG. 21.

Next, a description will be given of the connector according to a fourth embodiment, with reference to FIGS. 21 and 22.

A connector 66 according to the fourth embodiment is different from the above-mentioned connectors 30, 56 and 62 according to the first, second and third embodiments, respectively. A contact module 68 is formed symmetrically with respect to the middle point in the extending directions of a contact 70. Also, corresponding to this, a connector body 72 is also formed symmetrically with respect to the middle point in the extending directions of the contact 70. That is, in a pair of the contact modules 68 attached to the connector body 72 in an opposing manner, contact portions 74*a* and 74*b* formed at opposing ends of contacts 70 are formed into a shape capable of holding a mating member therebetween. By inserting and connecting boards 76 and 78 between the contact portions 74*a* and the contact portions 74*b*, respectively, the boards 76 and 78 are electrically connected via the connector 66 in the horizontal direction.

Hence, unlike a conventional method, it is not necessary to use two connectors (two piece type connectors) for connecting the boards 74 and 76.

Figure 23:
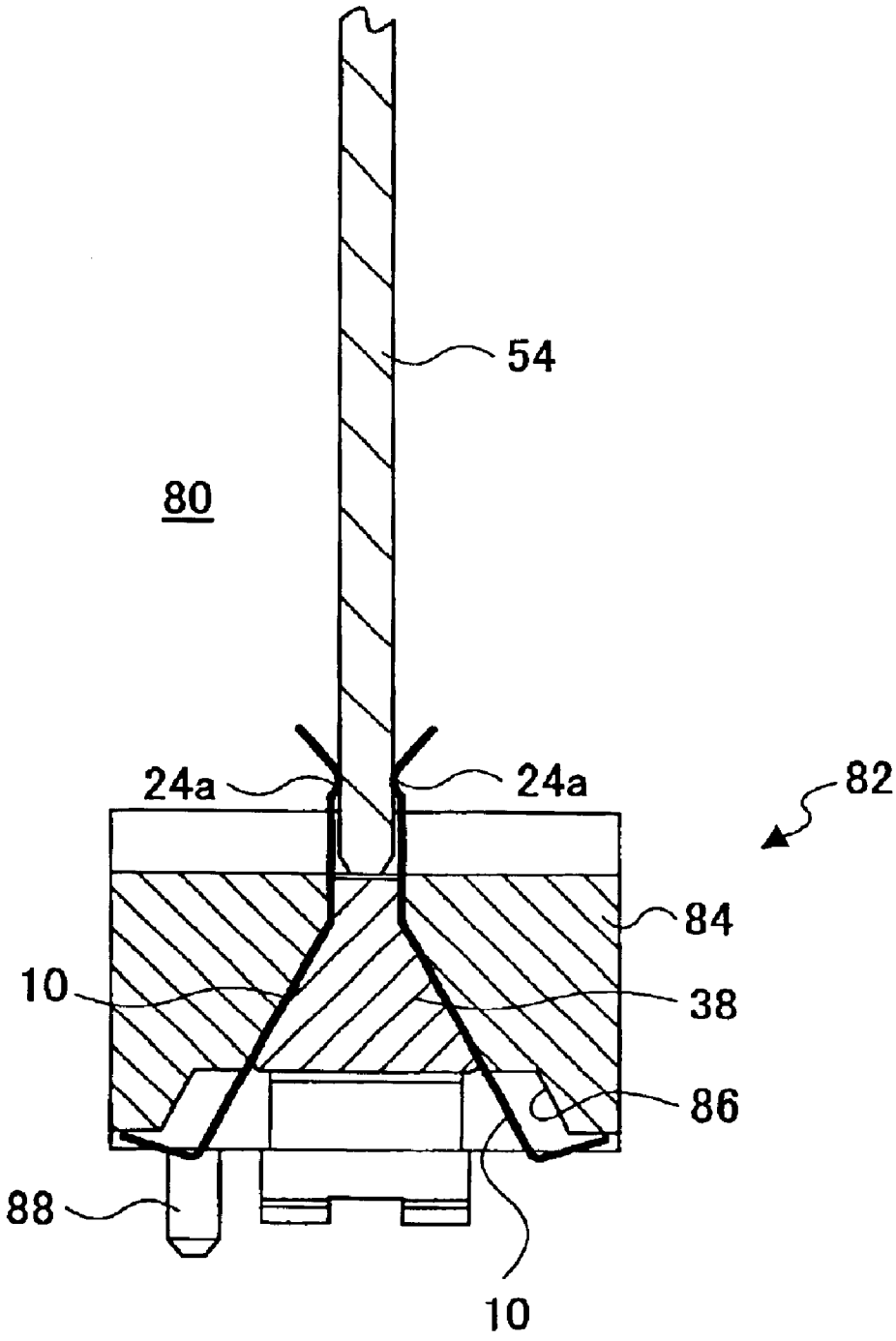
FIG. 23 is a partial cross-sectional view of the connector according to a fifth embodiment and a board connected to the connector.
Figure 24:
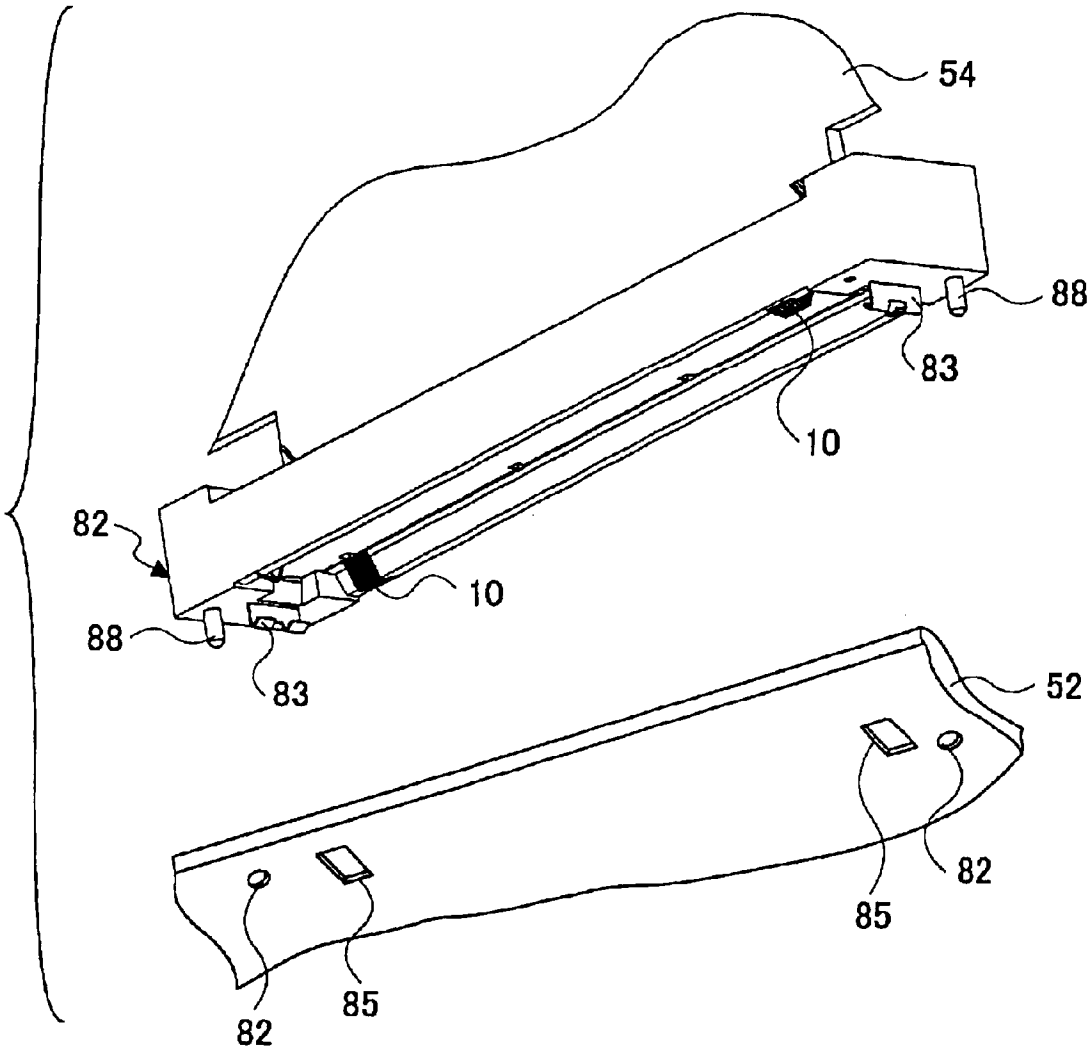
FIG. 24 is a perspective view showing the connector in FIG. 23 and a board as seen from the bottom surface side.
Figure 25:
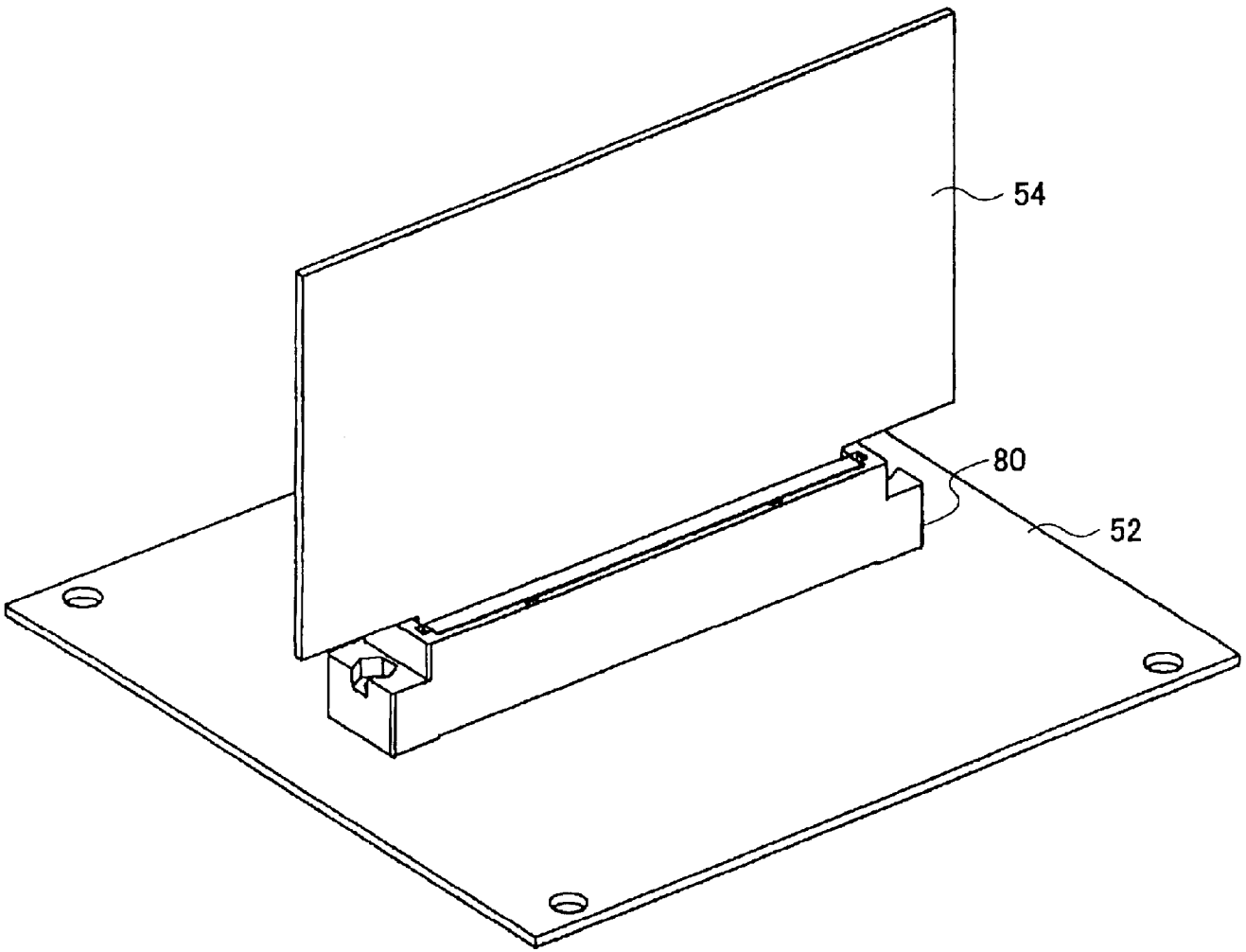
FIG. 25 is a perspective view of the connector in FIG. 23 and boards connected to the connector.

Next, a description will be given of the connector according to a fifth embodiment, with reference to FIGS. 23 through 25.

In a connector 80 according to the fifth embodiment, a pair of the contact modules 10 are attached to the inner walls constructing an opening 86 formed in a housing 84 of a connector body 82. The lower parts of the pair of the contact modules 10 are fixed by the supporting member 38 that is fit in the opening 86. The upper contact portions 24*a* of the respective contact modules 10 extend upward in FIG. 23 from the housing 84. In addition, locking parts 83 are provided to respective ends in the longitudinal directions of the contact modules 10. The locking parts 83 are bent twice (at two positions) so as to form claw shapes. Further, in FIGS. 23 and 24, the bottom surface of the connector body 82 is provided with a plurality of pin members 88 in a protruding manner.

When connecting the connector 80 to the board 52, the locking parts 83 are put through grooves 85 formed in the board 52 and locked to the board 52 while the pin members 88 are positioned by being inserted into holes 82 formed in the board 52. Hence, it is possible to positively fix the connector 80 to the board 52 (refer to FIG. 25).

When connecting the board 54 to the connector 80, since the contact modules 10 possess spring characteristics in the parts including the contact portions 24*a*, the parts (contacts) including the contact portions 24*a* are bent. Hence, the parts including the contact portions 24*a* make contact with the board 54 while the board 54 is being inserted, and after the insertion, it is possible to obtain contact force through the restoring force of the parts including the contact portions 24*a*. In other words, it is possible to easily realize the LIF structure with a simple structure. Further, after the board 54 is connected to the connector 80, the contact portions 24 are fastened to the board 54 by soldering, for example.

Figure 26:
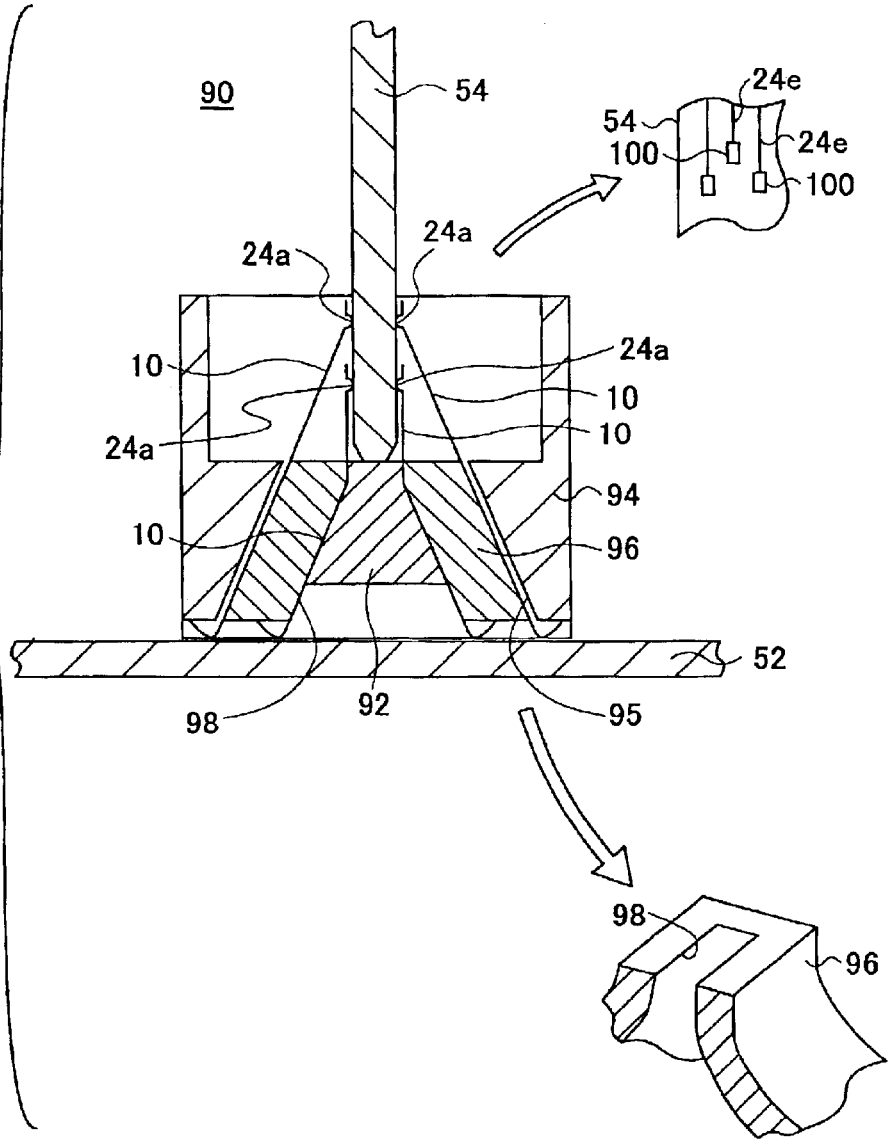
FIG. 26 is a partial cross-sectional view of the connector according to a sixth embodiment and boards connected to the connector.

Next, a description will be given of the connector according to a sixth embodiment, with reference to FIG. 26.

The basic structure of a connector 90 according to the sixth embodiment is similar to that of the connector 80 according to the fifth embodiment.

However, in the connector 90, an insertion member 96 is installed between a supporting member 92 and the inner walls constructing an opening 95 of a housing 94, and an opening 98 is formed in the insertion member 96. In addition, a pair of the facing contact modules 10 are attached between the supporting member 92 and the inner walls constructing the opening 98 of the insertion member 96 and between the outer walls of the insertion member 96 and the inner walls of the housing 94. In the pair of the contact modules 10 attached to the inner side, the upper contact portions 24*a* are arranged to the front side of the insertion direction of the board 54, that is, the lower side in FIG. 26. In the pair of the contact modules 10 attached to the outer side, the upper contact portions 24*a* are arranged to the back side of the insertion direction of the board 54, that is, the upper side in FIG. 26.

Further, when assembling the connector 90, the insertion member 96 is inserted into the opening 95 after the outer side contact modules 10 are temporarily fixed to the housing 94. Then, the inner side contact modules 10 are temporarily fixed to the inner walls of the insertion member 96. Thereafter, the supporting member 92 is inserted into the opening 98 and fixed. In this manner, the connector 90 is obtained.

It is possible to preferably use the connector 90 for connection to the board 52 where the circuit patterns 24*e* are finely arranged through arranging terminals (pads) 100 having a constant width alternately in a hound's tooth pattern.

Figure 27:
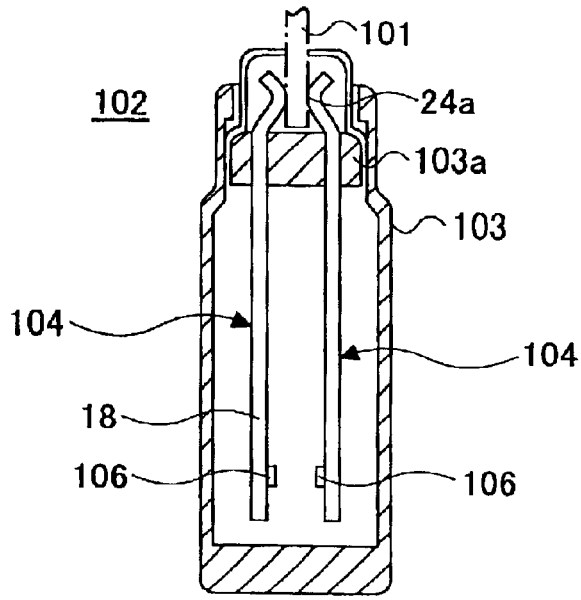
FIG. 27 is a cross-sectional view of the connector according to a seventh embodiment.
Figure 28:
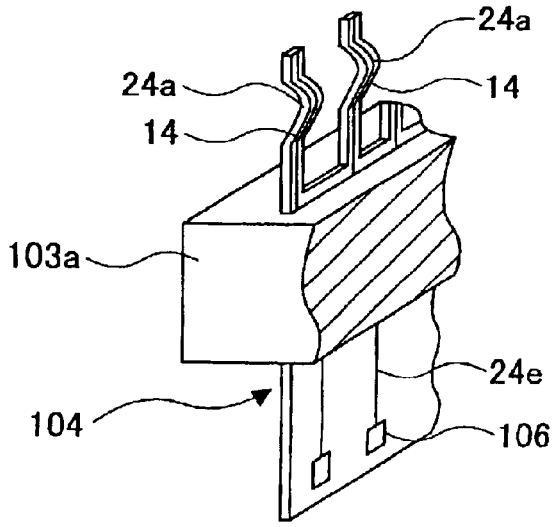
FIG. 28 is a perspective view of a contact module of the connector in FIG. 27.
Figure 29:
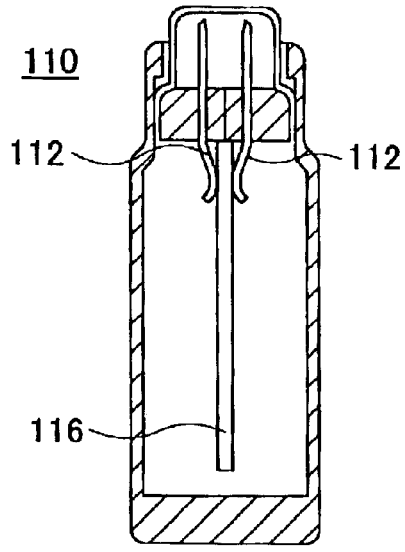
FIG.29 PRIOR ART
FIG. 29 is a cross-sectional view of a conventional connector for terminating resistance.
Figure 30:
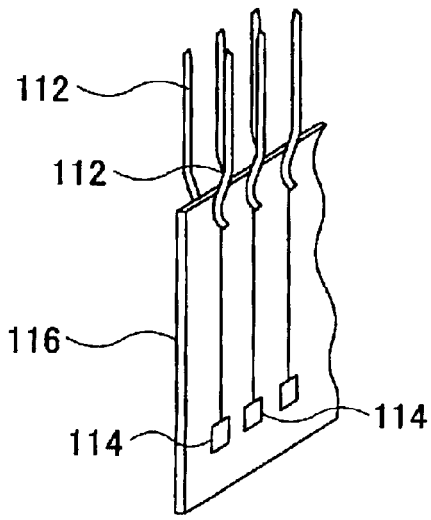
FIG.30 PRIOR ART
FIG. 30 is a perspective view of contacts of the connector in FIG. 29 and a board connected to the contact.

Next, a description will be given of the connector according to a seventh embodiment, with reference to FIGS. 27 through 30. FIGS. 27 and 28 show the connector according to the seventh embodiment. FIGS. 29 and 30 show a conventional connector for comparison.

A connector 102 according to the seventh embodiment is a connector for terminating resistance connected to a terminal connection board when electrically connecting a plurality of apparatuses.

A pair of contact modules 104 attached to a resin part 103*a* of a connector body 103 are slightly different from the above-mentioned contact modules 10. That is, on one ends (the upper side in FIGS. 27 and 28) of the contact modules 104, similar to the contact modules 10, the contact portions 24*a* of the contacts 14 are formed. On the other hand, on the other ends of the contact modules 104 connected to the circuit patterns 24*e*, resistances 106 are provided.

By connecting the connector 102 to a terminal apparatus connected to a plurality of apparatuses, such as a SCSI apparatus, signals flowing wires are stabilized.

In a case of a conventional connector 110 for terminating resistance shown in FIGS. 29 and 30, a board 116 with resistances 114 is connected to contacts 112. However, when the connector 102 is used, the board 116 is not required. Thus, the structure of the connector is simplified, and a smaller connector can be achieved.

A description will be given of a manufacturing method of the contact module 10 according to one embodiment of the present invention, with reference to FIGS. 31A through 34B. FIGS. 31A through 32B are schematic diagrams for explaining the processes of stacking each of the films on the sheet 18. FIGS. 33A through 34B are schematic diagrams for explaining the processes for cutting and bending the sheet 18 on which the films are stacked so as to form the contact module 10 according to this embodiment.

Figure 31A:
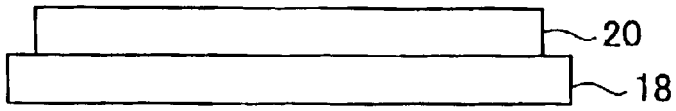
FIGS. 31A, 31B, 31C and 31D are schematic diagrams for explaining a manufacturing method of the contact module according to one embodiment of the present invention and show processes from forming of a base insulating film on a sheet to forming of a plating film.

First, the entire surfaces of the sheet 18 made of an SUS material is coated by polyimide resin and cured, and the base insulating film 20 is formed (refer to FIG. 31A).

Figure 31B:
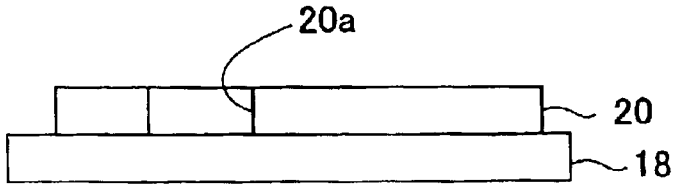
Figure 31C:
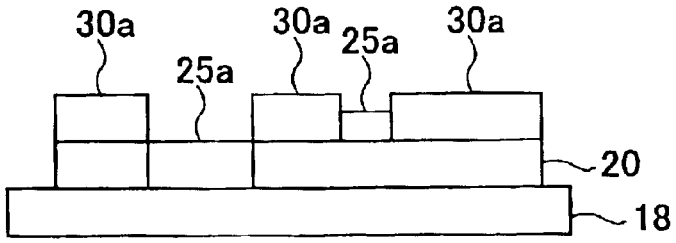
Figure 31D:
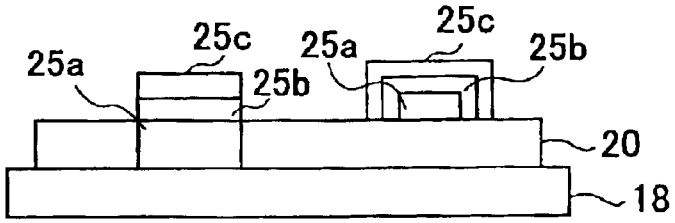

Next, a predetermined region of the part where the circuit pattern 14*e* of the contact 14*c* for ground is to be formed is etched, and the opening 20*a* from which the sheet 18 is exposed is formed on the base insulating film 20 (refer to FIG. 31B).

Then, a resist film 30*a* having a predetermined pattern is formed on the base insulating film 20. Thereafter, a copper plating process is performed so as to fill in the opening 20*a* with the copper plating film 25*a* and form a pattern of the copper plating film 25*a* on the part where the circuit pattern 14*e* is to be formed (refer to FIG. 31C).

Next, after eliminating the resist film 30*a*, the nickel plating film 25*b* and the gold plating film 25*c* are successively formed on the copper plating film 25*a* by electroplating. On this occasion, with respect to the copper plating films 25*a* in parts where the contact portions (contact points) 24*a* through 24*d* and the circuit patterns 24*e* are to be formed, the sides are also covered with the nickel plating film 25*b* and the gold plating film 25*c* (refer to FIG. 31D).

Figure 32A:
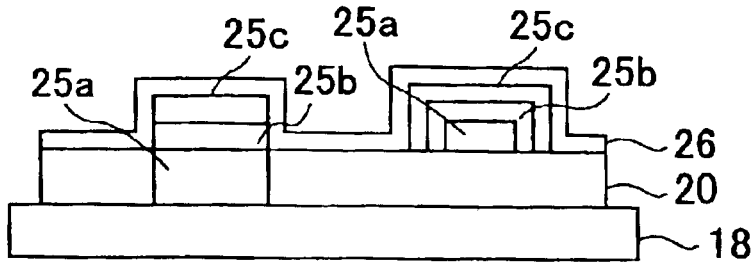
FIGS. 32A and 32B are schematic diagrams for explaining the manufacturing method of the contact module and show processes of forming of a cover insulating film and forming-of the outline shape, respectively.
Figure 32B:
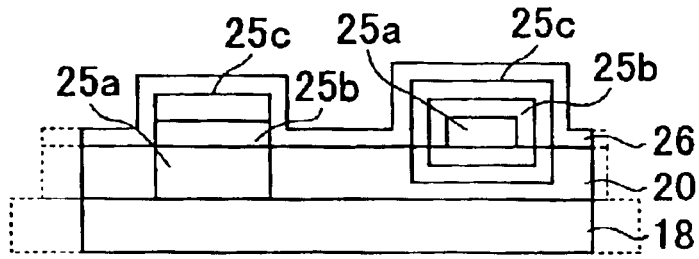

Then, parts where the circuit patterns 14*e* of the contacts 14*a* through 14*c* are to be formed and, in this case, parts forming both ends of the contacts 14*a* through 14*c* are coated with polyimide resin and cured so as to form the cover insulating film 26 (refer to FIG. 32A).

Further, an outline resist is performed and the cover insulating film 26 and the base insulating film 20 are etched. Thereafter, successively, the sheet 18 is etched, and the outline shape of the contact module 10 is formed. Thus, a plate-like contact module material where a plurality of the contacts 14 are separately formed on the sheet 18 is obtained (refer to FIG. 32B). Additionally, instead of an etching method, a punching press method may be used as a method of forming the outline shape of the contact module 10.

A description will be given of the processes for obtaining the shape of the contact module suitable for the conditions of use by using the sheet 18 where the films are stacked through the above-mentioned processes, cutting the contact module material into individual pieces and bending the pieces.

Figure 33A:
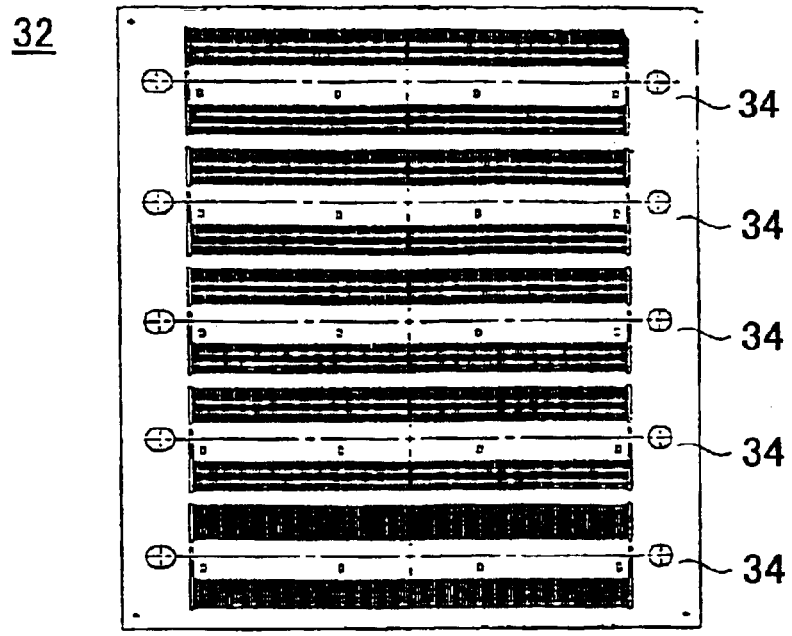
FIGS. 33A and 33B are schematic diagrams for explaining the manufacturing method of the contact module and show contact module material where five contact module parts are formed together and one contact module part obtained by cutting the contact module material, respectively.

As shown in FIG. 33A, five contact module parts 34, for example, are formed in the sheet 18 on which the films are stacked, that is, the above-described contact module material 32.

Figure 33B:
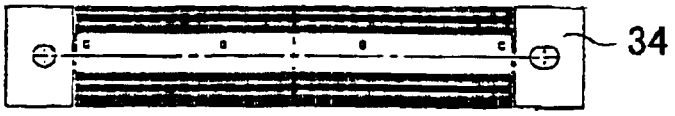

Five individualized contact module parts 34 are obtained by cutting the contact module material (FIG. 33B shows only one contact module part 34 obtained by cutting).

Figure 34A:
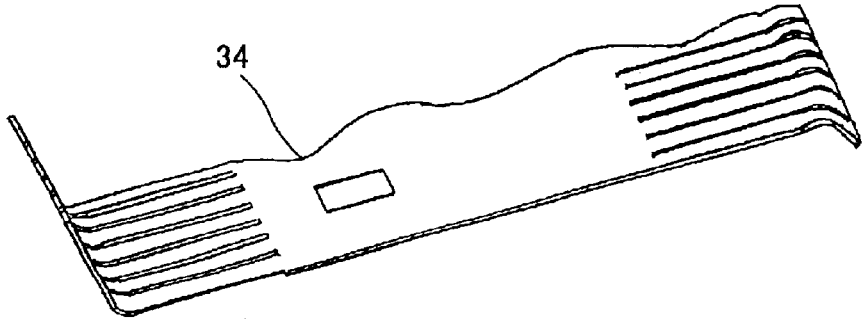
FIGS. 34A and 34B are schematic diagrams for explaining the manufacturing method of the contact module and show a state where both ends of the contact module part are bent and a state where the contact module is completed after further bending one of the ends, respectively.

Then, an end part of the contact module part 34, the end part including the contact portions (contact points), and the other end part of the contact module part 34 are bent into substantially L-shapes in mutually opposing directions (refer to FIG. 34A).

Last, a part on the other end part side of the contact module part 34, the part including the contact portions, is further bent into a substantially L-shape toward the direction opposite to the direction in which the other end part is bent. Thus, the contact module 10 according to this embodiment is completed (refer to FIG. 34B).

Figure 34B:
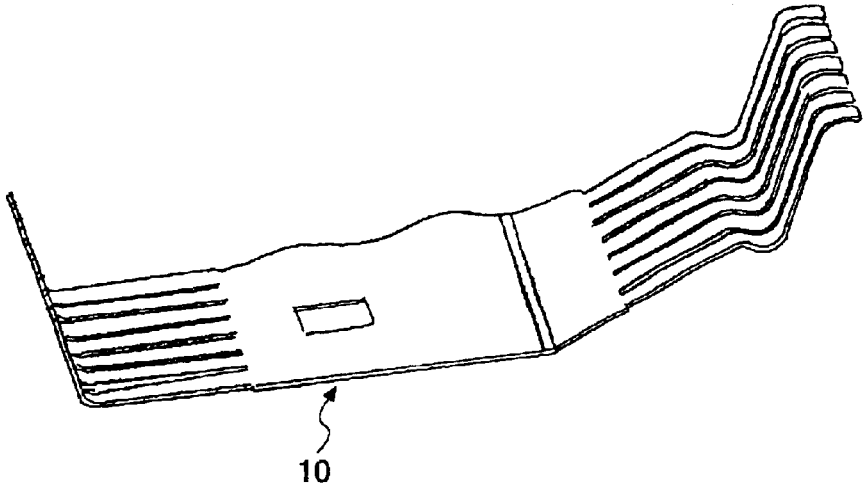
Figure 35:
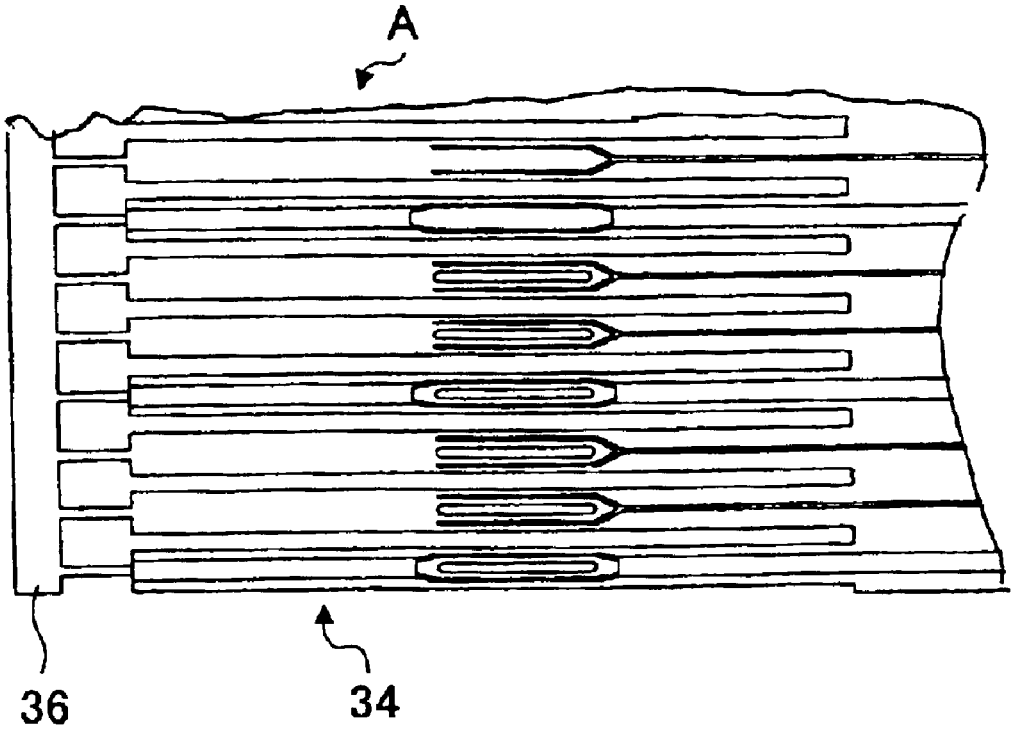
FIG. 35 is a segmented view of the contact module part showing a header-like part left in the bending process for explaining a variation of the manufacturing method of the contact module.

In addition, when bending the contact module part 34 shown in FIG. 33B so as to form the contact module part 34 shown in FIG. 34A, it is preferable that the bending be performed by leaving a header-like part 36 on the edge as shown in FIG. 35 without cutting the header-like part 36 beforehand, processing the contact module part 34 to the final shape as shown in FIG. 34B, and thereafter cutting the header-like part 36. Because, in this case, the protrusions (teeth of a comb-like parts) indicated by A in FIG. 35 of the contact module part 34 do not become apart. Also, in this case, the header-like part 36 may be left to the contact module 10.

According to the above-described manufacturing method of the contact module 10 according to this embodiment, by processing with the simple method such as etching using one sheet, it is possible to easily obtain a large number of contact modules having a plurality of contacts.

Next, a description will be given of variations of the contact module according to this embodiment, with reference to FIGS. 36A through 39.

Figure 36A:
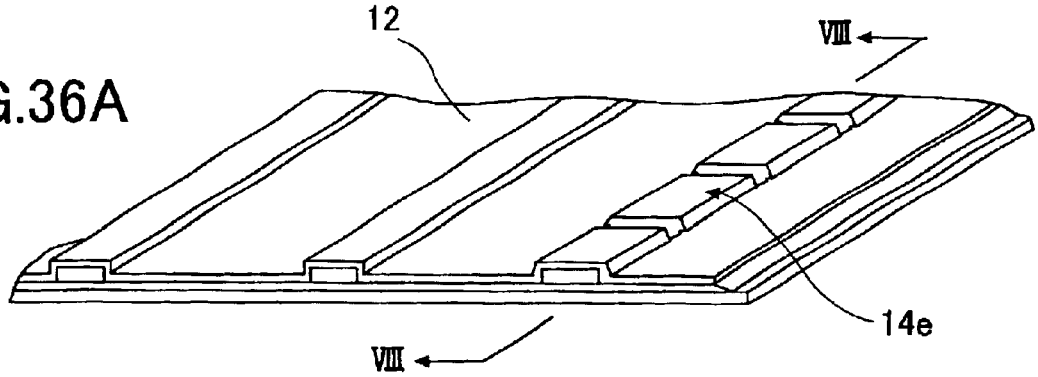
FIG. 36A is a segmented view of a base for explaining the first variation of the contact module having a connection structure of the plating film and sheet different from the connection structure shown in FIG. 6.
Figure 36B:
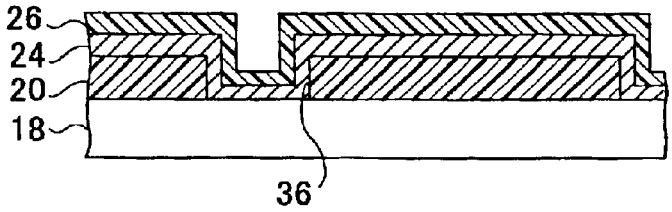
FIG. 36B is a partial cross-sectional view of the base taken along line VIII—VIII in FIG. 36.

As shown in FIGS. 36A and 36B, the contact module according to a first variation is different from the contact module shown in FIG. 6 in the structure of the circuit patterns 24*e* formed on the base 12 of the contact 14*c* for ground.

That is, in the circuit patterns 14*e* formed on the base 12 of the contact module according to the first variation, a plurality of holes (slits) 36 are formed in the base insulating film 20 in the extending direction of the circuit patterns 24*e*. The plating film 24 and the cover insulating film 26 are filled in the holes 36. Hence, the plating film 24 forming the circuit patterns 24*e* are connected to the sheet 18.

In the contact module according to the first variation, the circuit patterns 14*e* of the contacts 14*c* for ground are connected to the sheet 18 at a plurality of positions. Accordingly, it is possible to positively ground as in the contact module 10.

Next, a description will be given of the contact module according to a second variation where the pitch between the arranged contacts is suitably varied, with reference to FIGS. 37A and 37B.

Figure 37A:
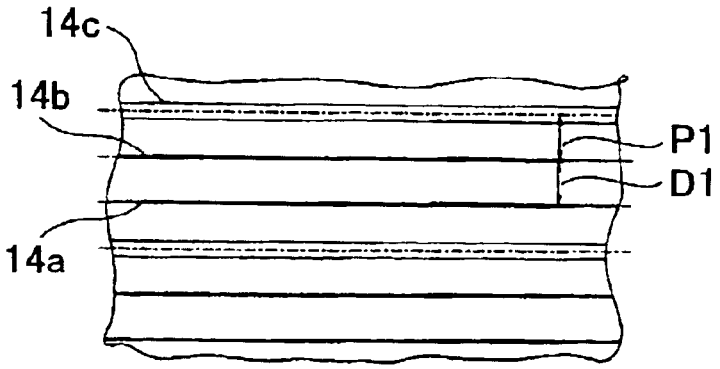
FIGS. 37A and 37B are schematic diagrams for explaining the pitch between the contacts of the contact module according to a second variation and show an arrangement having the same pitch and another arrangement having different pitches, respectively.

In a case shown in FIG. 37A, a pitch P1 between the contact 14*c* for ground and the adjacent contact 14*b* for signal and a pitch D1 between the adjacent contacts 14*b* and 14*c* for signal are formed with the same size.

Figure 37B:
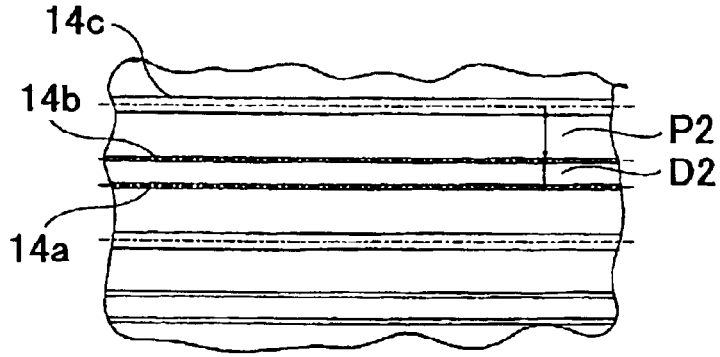

On the other hand, in a case shown in FIG. 37B, a pitch P2 between the contact 14*c* for ground and the adjacent contact 14*b* for signal is formed wider than a pitch D2 between the adjacent contacts 14*b* and 14*c* for signal.

Additionally, in a case of a single end type, only contacts for signal may be arranged with a constant pitch without providing contacts for ground, or the contacts for ground and the contacts for signal may be arranged alternatively with a constant pitch. Also, the contacts for ground may be arranged one every several numbers of contacts for signal with a constant pitch.

Further, in a case of differential (balanced transmission) type, a pair of contacts for positive and negative signals may be repeatedly arranged, or contacts for ground may be arranged one between adjacent pairs of the contacts of positive and negative signals. In addition, the contacts for ground may be arranged one between every two pairs of the contacts for positive and negative signals.

Figure 38:
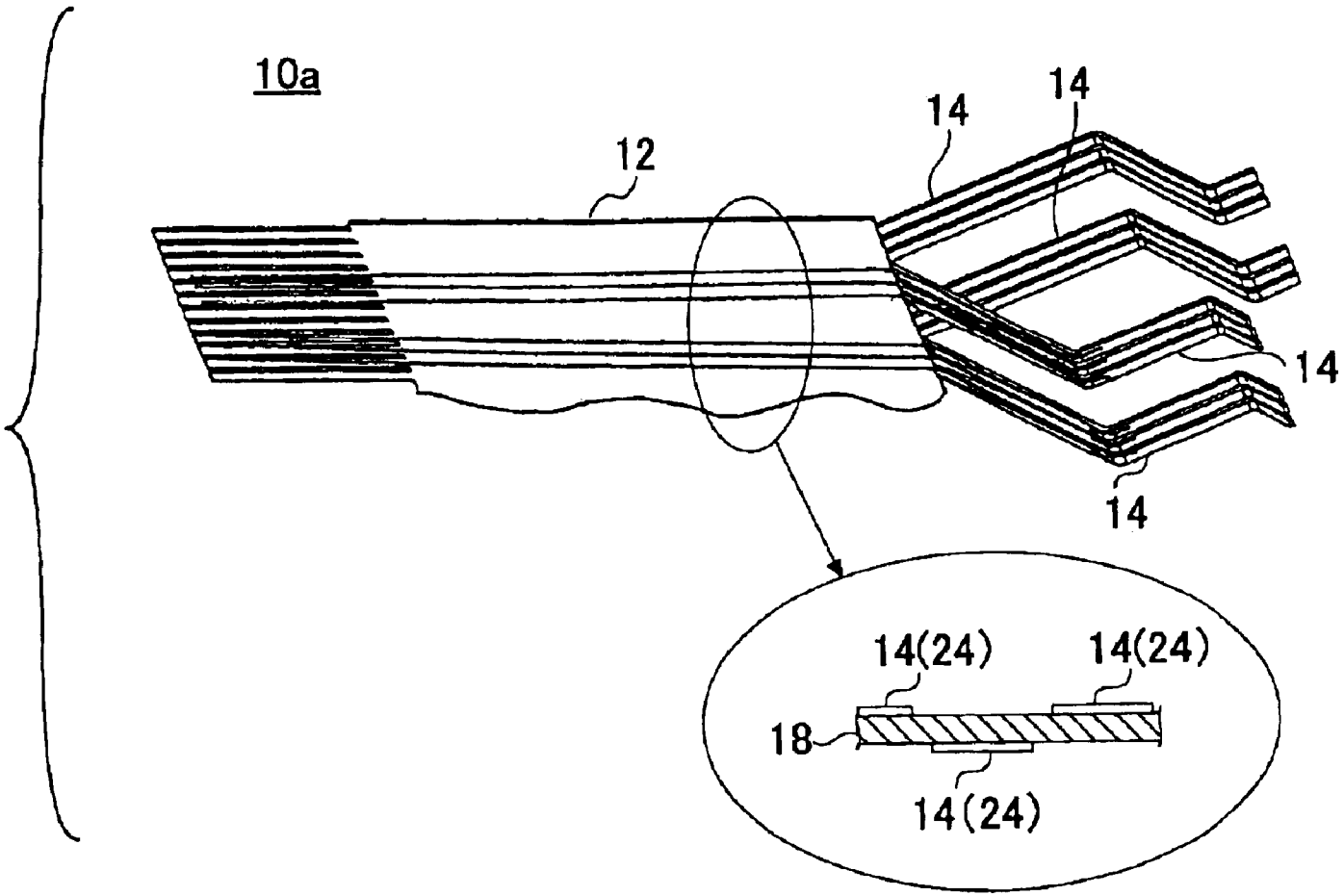
FIG. 38 is a segmented view of the contact module according to a third variation where contacts are formed on both sides of the sheet.

Next, as shown in FIG. 38, in a contact module 10*a* according to a third variation, the contacts 14 having the contact portions and circuit patterns are arranged on both sides of the sheet 18 such that the opposing contacts 14 are shifted relative to each other in a hound's tooth manner.

Hence, it is possible to use the contact module 10*a* in various modes.

Figure 39:
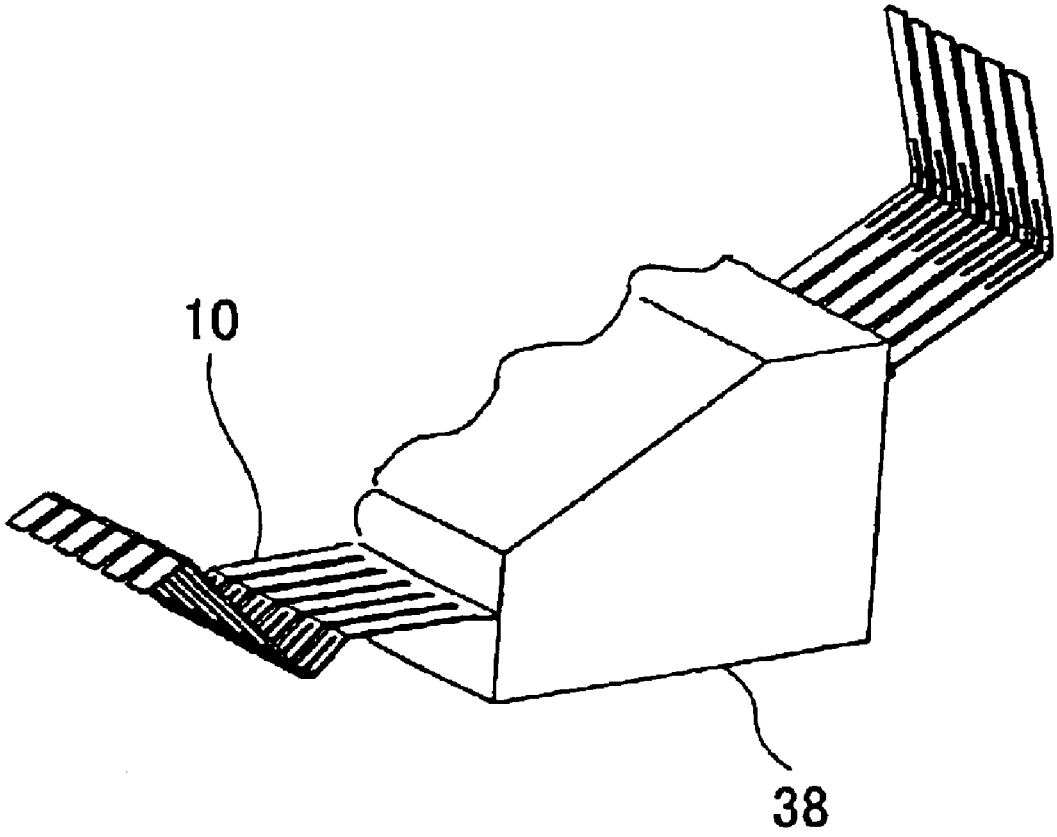
FIG. 39 is a perspective view showing a state where the contact module according to a fourth variation is mounted on a resin part.

Next, as shown in FIG. 39, in the contact module according to a fourth variation, the contact module 10 is mounted on a resin part 38 by insert molding.

Accordingly, it is easy to use the contact module. Also, when assembling the connector, it is possible to easily assemble the connector by fitting the resin part 38 in a concave part of another resin part 38 having a complementary shape and installed in the connector body beforehand.

The present invention is not limited to the specifically disclosed embodiments, and variations and modifications may be made without departing from the scope of the present invention.

The present application is based on Japanese priority applications No. 2002-193882 filed on Jul. 2, 2002 and No. 2002-193883 filed on Jul. 2, 2002, the entire contents of which are hereby incorporated by reference.

What is claimed is:

1. A contact module, comprising:

a strip base;

a plurality of first protrusions continuously extending from a first end of the base and including same materials as the base, said first protrusions each having a first contact portion and having spring characteristics at least in a part including said first contact portion; and a plurality of second protrusions continuously extending from a second end of the base and including the same materials as the base, said second protrusions each having a second contact portion and having spring characteristics at least in a part including said second contact portion, the second end being opposite to the first end, wherein said base comprises a sheet made of a metal material, an insulating film formed on at least one side of said sheet, and a film including a noble metal material formed on the insulating film, wherein said film forms said first and second contact portions and circuit patterns, said circuit patterns being formed between the first and second contact portions and covered with an insulating film, wherein the first and second contact portions and the circuit patterns integrally form a plurality of contacts, said contacts each comprising one of the first contact portions, a corresponding one of the second contact portions, and the circuit pattern therebetween, and wherein the contacts form signal lines and ground lines on the insulating film provided on the sheet made of the metal material, the ground lines are electrically connected to the sheet via elongated openings formed in the insulating layer, and the ground lines are arranged along the signal lines.

2. The contact module as claimed in claim 1, wherein the first protrusions are bent toward a predetermined direction at respective end parts thereof and further bent toward a direction opposite to the predetermined direction to form the respective first contact portions, and the second protrusions are bent toward the direction opposite to the predetermined direction to form the respective second contact portions.

3. The contact module as claimed in claim 1, wherein each of the ground lines includes at least one slit so as to expose the sheet from the slit and to connect the ground line to the sheet via the slit, the slit extending in a width direction of the ground line and arranged in a longitudinal direction of the ground line, and the circuit patterns contact the sheet via the slit.

4. The contact module as claimed in claim 1, wherein the elonoated openings extend in a longitudinal direction of the ground lines so as to expose the sheet from the elongated openings, and the circuit patterns contact the sheet via the elonoated openings.

5. The contact module as claimed in claim 1, wherein each of the first and second contact portions is biforked.

6. A connector connecting first and second boards, comprising:

a connector body; and at least one pair of contact modules provided in the connector body in a mutually opposing manner, the contact modules each comprising:

a strip base;

a plurality of first protrusions continuously extending from a first end of the base and including same materials as the base, said first protrusions each having a first contact portion and having spring characteristics at least in a part including said first contact portion; and a plurality of second protrusions continuously extending from a second end of the base and including the same materials as the base, said second protrusions each having a second contact portion and having spring characteristics at least in a part including said second contact portion, the second end being opposite to the first end, said base comprising:

a sheet made of a metal material;

an insulating film formed on at least one side of said sheet; and a film including a noble metal material formed on the insulating film.

wherein said film forms said first and second contact portions and circuit patterns, said circuit patterns being formed between the first and second contact portions, the first and second contact portions and the circuit patterns integrally form a plurality of contacts, said contacts each comprising one of the first contact portions, a corresponding one of the second contact portions, and the circuit pattern therebetween, and the connector body comprises a pair of press members having respective concave parts catching ends of the first protrusions of the corresponding contact modules, the press members moving backward and forward so as to change a distance between the opposing first contact portions of the pair of the contact modules.

7. The connector as claimed in claim 6, wherein the first protrusions are bent toward a predetermined direction at respective end parts thereof and further bent toward a direction opposite to the predetermined direction to form the respective first contact portions, and the second protrusions are bent toward the direction opposite to the predetermined direction to form the respective second contact portions.

8. The connector as claimed in claim 6, wherein the circuit patterns are covered with an insulating film.

9. The connector as claimed in claim 6, wherein each of the first and second contact portions is biforked.

10. The connector as claimed in claim 6, wherein the pair of the press members each comprises:

a slider member provided on a back surface side of a corresponding one of the contact modules, catching ends of the first protrusions of the corresponding contact module, and being capable of sliding so as to vary the distance between the opposing first contact portions; and a fitting member mounted between the slider member and the connector body after the first board is inserted between the pair of the contact modules so as to slide the slider member.

11. The connector as claimed in claim 6, wherein the pair of the press members each comprises:

a slider member provided on a back surface side of a corresponding one of the contact modules, catching ends of the first protrusions of the corresponding contact module, and being capable of sliding so as to vary the distance between the opposing first contact portions;

an elastic member installed between a back surface of the slider member and an inner wall of the connector body and urging the slider member to slide; and a fitting member mounted between the slider member and the connector body after the first board is inserted between the pair of the contact modules so as to slide the slider member.

12. The connector as claimed in claim 6, wherein, in each of the contact modules, the first protrusions are projected toward an insertion position of the first board, a circuit pattern side of the contact module from the first contact portions are fixed to the connector body, and top sides of the first protrusions, said top sides being opposite to the circuit pattern side, are caught by a concave part formed in the slider member.

13. The connector as claimed in claim 6, wherein, in each of the contact modules, the second protrusions are bent and formed into substantially L-shapes, corners of the L-shaped second protrusions are connected, as the second contact portions, to terminals formed on the second board to which principal surface the first board is arranged perpendicularly, a circuit pattern side of the contact modules from the second contact portions are fixed to the connector body, and top sides of the second protrusions, said top sides being opposite to the circuit pattern side, are caught by a concave part formed in the connector body.

14. The connector as claimed in claim 6, wherein, in the second protrusions, parts including the respective second contact portions are formed into pin shapes so as to be put through throughholes formed in the second board so that the first board is fixed to the second board to which principal surface the first board is arranged perpendicular.

15. The connector as claimed in claim 6, wherein the pair of the contact modules hold the first and second boards between the first and second contact portions, respectively, so as to connect the first and second boards in a horizontal direction.

16. The connector as claimed in claim 6, wherein a plurality of pairs of the contact modules are provided in the connector body in a mutually opposing manner such that first contact portions contact the first board and the second contact portions contact the second board.

17. The connector as claimed in claim 6, wherein the contacts include a ground contact serving as a ground line.

18. The connector as claimed in claim 17, wherein the ground contact includes at least one slit in the insulating film so as to expose the sheet from the slit, the slit extending in a width direction of the ground contact and arranged in a longitudinal direction of the ground contact, and the circuit pattern contacts the sheet via the slit.

19. The connector as claimed in claim 17, wherein the ground contact includes a long groove extending in a longitudinal direction of the ground contact so as to expose the sheet from the slit, and the circuit pattern contacts the sheet via the long groove.

* * * * *